US010525715B2

(12) United States Patent
Kobayashi et al.

(10) Patent No.: US 10,525,715 B2
(45) Date of Patent: Jan. 7, 2020

(54) LIQUID CARTRIDGE INCLUDING MEMORY MOUNTED ON SUBSTRATE

(71) Applicant: BROTHER KOGYO KABUSHIKI KAISHA, Nagoya-shi, Aichi-ken (JP)

(72) Inventors: Tetsuro Kobayashi, Chiryu (JP); Takahiro Miyao, Nagoya (JP); Hiroaki Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/118,631

(22) Filed: Aug. 31, 2018

(65) Prior Publication Data

US 2019/0299637 A1 Oct. 3, 2019

(30) Foreign Application Priority Data

Mar. 29, 2018 (JP) ..... 2018-064181

(51) Int. Cl.
*B41J 2/175* (2006.01)

(52) U.S. Cl.
CPC ..... *B41J 2/17546* (2013.01); *B41J 2/1753* (2013.01); *B41J 2/17513* (2013.01); *B41J 2/17523* (2013.01); *B41J 2/17553* (2013.01)

(58) Field of Classification Search
CPC ..... B41J 2/14233; B41J 2/14274; B41J 2/17546; B41J 2/17553; B41J 2/17523;
(Continued)

(56) References Cited

U.S. PATENT DOCUMENTS 5,610,635 A 3/1997 Murray et al.
7,168,797 B2 1/2007 Arai et al.
(Continued)

FOREIGN PATENT DOCUMENTS

CN 204605193 U 9/2015
EP 2 436 525 A1 4/2012
(Continued)

OTHER PUBLICATIONS

IP.com search (Year: 2019).*
(Continued)

*Primary Examiner* — Lisa Solomon
(74) *Attorney, Agent, or Firm* — Merchant & Gould P.C.

(57) ABSTRACT

There is provided a liquid cartridge configured to be inserted into an attachment portion of a printing device in an insertion direction crossing a gravitational direction and attached to the attachment portion in an upright posture. The liquid cartridge includes a liquid chamber storing liquid therein, a liquid passage extending forward in the insertion direction from the liquid chamber, a substrate, a contact and a memory electrically connected to the contact. The substrate has a first surface and a second surface opposite to each other. The first surface includes: a first region facing upward; and a second region lower than the first region in the upright posture. The contact is formed on the first region and is electrically connectable to a contact of the printing device. The memory is mounted on the substrate at a position lower than the contact of the cartridge in the upright posture.

20 Claims, 21 Drawing Sheets

(58) Field of Classification Search
CPC .. B41J 2/17513; B41J 2/1753; H01L 41/0471
See application file for complete search history.

(56) References Cited

U.S. PATENT DOCUMENTS

| | | | |
|---|---|---|---|
| 2002/0085075 | A1 | 7/2002 | Shinada et al. |
| 2006/0012651 | A1 | 1/2006 | Lee et al. |
| 2013/0162733 | A1 | 6/2013 | Nakamura et al. |
| 2016/0059574 | A1 | 3/2016 | Saikawa |
| 2016/0221350 | A1* | 8/2016 | Takagi ..... B41J 2/1752 |
| 2016/0279955 | A1 | 9/2016 | Wang et al. |
| 2018/0178528 | A1 | 6/2018 | Nakazawa et al. |

FOREIGN PATENT DOCUMENTS

| | | | |
|---|---|---|---|
| EP | 2 653 313 | A2 | 10/2013 |
| EP | 3 300 901 | A1 | 4/2018 |
| JP | 2013-49164 | A | 3/2013 |
| JP | 2017-56686 | A | 3/2017 |

OTHER PUBLICATIONS

Extended European Search Report issued in related European Patent Application No. 18192071.1, dated Feb. 1, 2019.
Extended European Search Report issued in related European Patent Application No. 18192077.8, dated Dec. 11, 2018.
Office Action (Notice of Allowance) issued in related U.S. Appl. No. 16/118,604, dated Jul. 25, 2019.

* cited by examiner

LIQUID CARTRIDGE INCLUDING MEMORY MOUNTED ON SUBSTRATE

CROSS REFERENCE TO RELATED APPLICATION

This application claims priority from Japanese Patent Application No. 2018-064181 filed Mar. 29, 2018. The entire content of the priority application is incorporated herein by reference.

TECHNICAL FIELD

The present disclosure relates to a liquid cartridge storing liquid therein, and a system including the liquid cartridge, and an attachment section to which the liquid cartridge is attachable.

BACKGROUND

One conventional system known in the art includes an ink cartridge, and an inkjet recording device. The inkjet recording device includes attachment section, and the ink cartridge can be mounted into and extracted from the attachment section. The attachment section of the inkjet recording device includes contacts.

A circuit board may be provided at an ink cartridge (see Japanese Patent Application Publication No. 2013-049164, for example). Memory is mounted on the circuit board for storing such information as a color and material composition of ink stored in the cartridge, a residual quantity of ink, and the like. Electrodes are also formed on the circuit board. Electrical connections are formed between the electrodes on the ink cartridge and the contacts in the attachment section when the ink cartridge is mounted in the attachment section, enabling the inkjet recording device to read information stored in the memory.

SUMMARY

However, as the functionality of circuit boards continues to improve, the number of components mounted on the circuit boards has increased. For example, batteries and other components are now being mounted on these circuit boards in addition to memory. Such additions increase the size of the circuit board. As a consequence, enlarged parts of the circuit board are susceptible to contacting the attachment section and becoming damaged as the ink cartridge is being mounted into the attachment section.

In view of the foregoing, it is an object of the present disclosure to provide a liquid cartridge capable of reducing a potential for damage to a circuit board. It is another object of the present invention to provide a system including this liquid cartridge.

In order to attain the above and other objects, according to one aspect, the present disclosure provides a liquid cartridge configured to be inserted into an attachment portion of a printing device in an insertion direction crossing a gravitational direction and attached to the attachment portion in an upright posture, the attachment portion including a contact. The liquid cartridge includes a liquid chamber storing liquid therein, a liquid passage, a substrate, a contact and a memory. The liquid passage is in communication with the liquid chamber and extends frontward in the insertion direction from the liquid chamber. The substrate has a first surface and a second surface opposite to each other. The first surface includes a first region and a second region. The first region faces upward in the upright posture, and the second region is positioned lower than the first region in the upright posture. The contact of the cartridge is formed on the first region of the first surface. The contact of the cartridge is electrically connectable to the contact of the device. The memory is electrically connected to the contact of the device and is mounted on the substrate at a position lower than the contact of the cartridge in the upright posture.

The above liquid cartridge may further include an electronic component electrically connected to the memory and configured to supply power to the memory. In this case, the electronic component may be any types of electronic components or elements that can serve as means for supplying power to the memory. For example, the electronic component may be a battery or a capacitor in a charged state.

According to another aspect, the present disclosure also provides a system including the above liquid cartridge and an attachment portion of a printing device. The liquid cartridge is configured to be inserted into the attachment portion in an insertion direction and is attached to the attachment portion in an upright posture. The attachment portion includes: a holder defining an internal space therein for accommodating the liquid cartridge in the upright posture; a tube provided at the holder and connectable to the liquid passage of the liquid cartridge; and a connector. The holder includes: a bottom wall; an upper wall spaced apart from the bottom wall in a height direction parallel to the gravitational direction in the upright posture; and a pair of side walls each connecting the bottom wall and the upper wall, the side walls being spaced apart from each other in a widthwise direction orthogonal to the height direction and the insertion direction, the upper wall, the bottom wall and the pair of side walls defining the internal space. The connector includes: a contact disposed at the upper wall and configured to contact the contact of the liquid cartridge in the attached state; a first wall having a first lower end in the height direction, the first lower end being positioned lower than the contact of the device in the height direction; and a second wall spaced apart from the first wall in the insertion direction, the second wall having a second lower end in the height direction, the second lower end being positioned lower than the contact of the device in the height direction. The contact of the device is positioned between the first wall and the second wall in the insertion direction. The second region of the substrate is separated from one of the first lower end and the second lower end in the height direction in the attached state of the liquid cartridge.

According to still another aspect, the present disclosure also provides a liquid cartridge configured to be inserted into an attachment portion of a printing device in an insertion direction crossing a gravitational direction and attached to the attachment portion in an upright posture, the attachment portion including a contact. The liquid cartridge includes a liquid chamber storing liquid therein, a liquid passage, a substrate, a contact and a memory. The liquid passage is in communication with the liquid chamber and extends frontward in the insertion direction from the liquid chamber. The substrate has a first surface and a second surface opposite to each other. The first surface includes: a first region facing upward in the upright posture; a second region positioned lower than the first region in the upright posture; and a third region positioned rearward in the insertion direction relative to the second region in the upright posture, the third region being positioned higher than the second region in the upright posture. The contact of the cartridge is formed on the first region of the first surface and is electrically connectable to the contact of the device. The memory is electrically connected to the contact of the cartridge. The memory is mounted at one of the second surface and the third region.

DETAILED DESCRIPTION

Hereinafter, an embodiment of the disclosure will be described in detail while referring to accompanying drawings. It would be apparent to those skilled in the art that the embodiment described below is merely an example of the present disclosure and modifications and variations may be made therein without departing from the scope of the disclosure.

<Overview of Printer 10>

Figure 1:
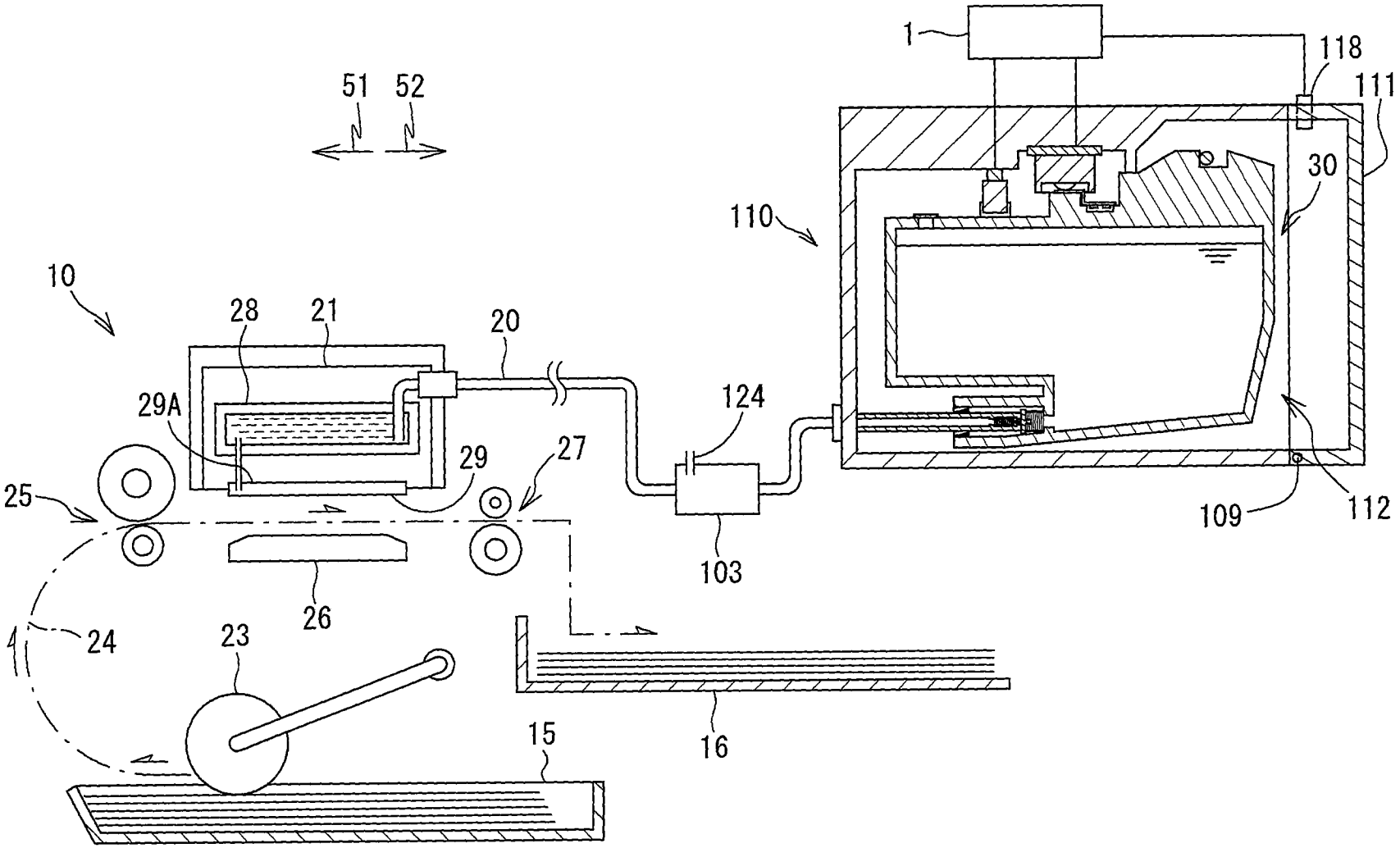
FIG. 1 is a vertical cross-sectional diagram schematically illustrating an internal structure of a printer according to an embodiment of the present disclosure.

As shown in FIG. 1, a printer 10 according to the embodiment is configured to record images on sheets of paper based on an inkjet recording method of ejecting ink droplets toward the sheets. The printer 10 includes a recording head 21, a cartridge-attachment portion 110, and ink tubes 20. Ink cartridges 30 storing ink to be supplied to the recording head 21 are detachably attachable to the cartridge-attachment portion 110. The ink tubes 20 connect the recording head 21 to the cartridge-attachment portion 110. An opening 112 is formed in one end of the cartridge-attachment portion 110. The ink cartridge 30 and the cartridge-attachment section 110 of the printer 10 constitute a system of the present disclosure.

Figure 9:
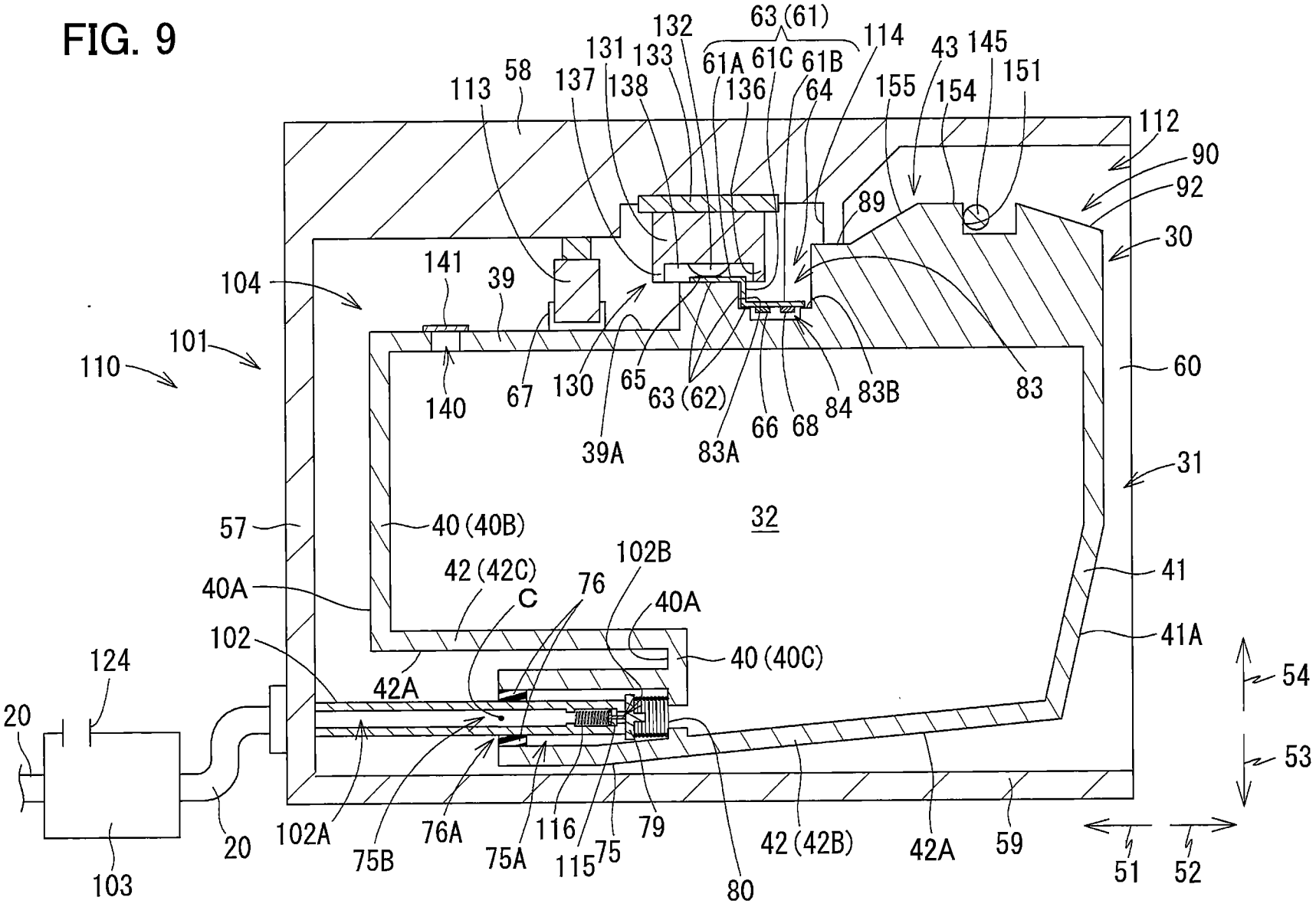
FIG. 9 is a vertical cross-sectional view of the ink cartridge according to the embodiment attached to the cartridge-attachment section, the ink cartridge being in the upright posture.

The ink cartridges 30 are inserted into the cartridge-attachment portion 110 through the opening 112 in order to be attached to the cartridge-attachment portion 110. The ink cartridges 30 are also extracted from the cartridge-attachment portion 110 through the opening 112. FIG. 1 shows one of the ink cartridges 30 in its attached state in the cartridge-attachment portion 110, i.e., when the ink cartridge 30 has been completely attached to the cartridge-attachment portion 110. FIG. 9 shows the ink cartridge 30 and cartridge-attachment portion 110 of FIG. 1. That is, FIG. 9 shows the attached state of the ink cartridge 30.

In the following description, as shown in FIG. 9, a frontward direction 51 is defined as a direction in which the ink cartridge 30 is inserted into the cartridge-attachment portion 110. Further, a posture of the ink cartridge 30 when being inserted forward into and attached to the cartridge-attachment portion 110 is defined as an upright posture. Hence, when in its attached state, the ink cartridge 30 is in the upright posture. FIGS. 1 and 4 through 9 illustrate the ink cartridge 30 in this upright posture. A rearward direction 52 is defined as a direction opposite the frontward direction 51, and is a direction in which the ink cartridge 30 is extracted from the cartridge-attachment portion 110. In the present embodiment, a horizontal direction is defined as a direction orthogonal to the direction of gravity and parallel to the insertion direction. Both the frontward direction 51 and rearward direction 52 are parallel to the horizontal direction (direction orthogonal to the direction of gravity). The frontward direction 51 and rearward direction 52 intersect the direction of gravity. Further, a downward direction 53 is defined as the direction of gravity, and an upward direction 54 is defined as a direction opposite the direction of gravity. As shown in FIGS. 5A and 5B, a rightward direction 55 and a leftward direction 56 are defined as directions orthogonal to the frontward direction 51 and downward direction 53. More specifically, when the ink cartridge 30 is in its upright posture (the attached state shown in FIG. 1), the rightward direction 55 is defined as a direction extending rightward and the leftward direction 56 as a direction extending leftward when the ink cartridge 30 is viewed from the rear, as illustrated in FIG. 5A.

Further, in the following description, the frontward direction 51 and rearward direction 52 are collectively referred to as a front-rear direction, the upward direction 54 and downward direction 53 are collectively referred to as a vertical direction, and the rightward direction 55 and leftward direction 56 are collectively referred to as a left-right direction.

In the state where the ink cartridge 30 is completely attached to the cartridge-attachment portion 110, the ink cartridge 30 has a height in the up-down direction; a depth in the front-rear direction (i.e., in the insertion direction); and a width in the left-right direction (i.e., widthwise direction).

When the ink cartridge 30 is in its upright posture, the width direction of the ink cartridge 30 corresponds to the left-right direction, the height direction of the ink cartridge 30 corresponds to the vertical direction, and the depth direction of the ink cartridge 30 corresponds to the front-rear direction.

While in its upright posture, the ink cartridge 30 is inserted forward into the cartridge-attachment portion 110 through the opening 112 (see FIGS. 7 and 8) until the ink cartridge 30 is mounted in the cartridge-attachment portion 110 (see FIG. 9). The ink cartridge 30 is also extracted rearward from the cartridge-attachment portion 110 while in its upright posture.

The ink cartridge 30 stores ink that the printer 10 can use for printing. As shown in FIG. 1, the ink cartridge 30 is connected to the recording head 21 by the ink tube 20 when the ink cartridge 30 is in its attached state in the cartridge-attachment portion 110. The recording head 21 includes sub-tanks 28, and nozzles 29. Each of the sub-tanks 28 temporarily holds ink to be supplied through the corresponding ink tube 20. The recording head 21 ejects ink supplied from the sub-tanks 28 through the nozzles 29 according to an inkjet recording method. More specifically, the recording head 21 includes a head control board (not shown), and piezoelectric elements 29A corresponding one-on-one to the nozzles 29. The head control board selectively applies drive voltages to the piezoelectric elements 29A in order to eject ink from the nozzles 29.

The printer 10 also includes a sheet tray 15, a feed roller 23, a conveying path 24, a pair of conveying rollers 25, a platen 26, a pair of discharge rollers 27, and a discharge tray 16. The feed roller 23 feeds each of the sheets from the sheet tray 15 onto the conveying path 24, and the conveying rollers 25 convey the sheet over the platen 26. The recording head 21 ejects ink onto the sheet as the sheet passes over the platen 26, whereby an image is recorded on the sheet. The discharge rollers 27 receive the sheet that has passed over the platen 26 and discharge the sheet into the discharge tray 16 provided on a downstream end of the conveying path 24.

<Cartridge-Attachment Portion 110>

Figure 2:
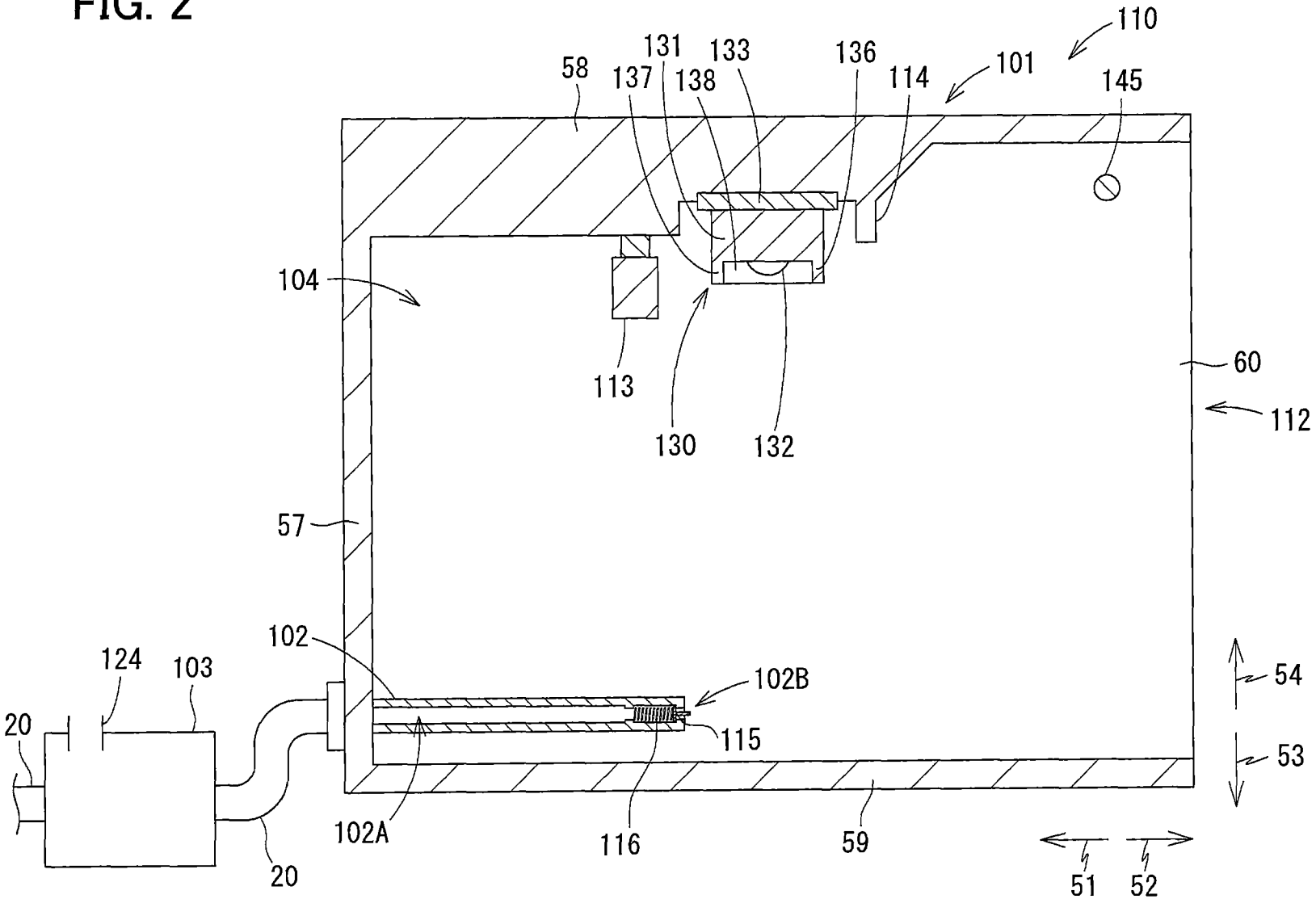
FIG. 2 is a vertical cross-sectional view of a cartridge-attachment section according to the embodiment.

As shown in FIG. 2, the cartridge-attachment portion 110 includes a cartridge holder 101, a cover 111, a cover sensor 118, tubes 102, a shaft 145, tanks 103, optical sensors 113, protruding parts 114, and connectors 130.

<Cartridge Holder 101>

The cartridge holder 101 shown in FIG. 2 constitutes a casing of the cartridge-attachment portion 110. The cartridge holder 101 has a box shape. An interior space 104 is formed inside the cartridge holder 101.

As shown in FIG. 2, the cartridge holder 101 is provided with an end wall 57, a bottom wall 59, a top wall 58, and a pair of side walls 60. The bottom wall 59 extends rearward from a bottom edge of the end wall 57. The top wall 58 extends rearward from a top edge of the end wall 57 and is separated vertically from the bottom wall 59. The side walls 60 extend rearward from respective right and left edges of the end wall 57. The side wall 60 extending from the right edge of the end wall 57 is connected to right edges of the bottom wall 59 and top wall 58, while the side wall 60 extending from the left edge of the end wall 57 is connected to left edges of the bottom wall 59 and top wall 58. Hence, the side walls 60 connect the top wall 58 to the bottom wall 59.

The opening 112 is formed in a rear end of the cartridge holder 101 to oppose the end wall 57 in the front-rear direction. The opening 112 is in communication with the interior space 104 of the cartridge holder 101. A user faces the opening 112 when using the printer 10.

The interior space 104 of the cartridge holder 101 is defined by the end wall 57, bottom wall 59, top wall 58, and side walls 60. Partitioning walls (not shown) partition the interior space 104 into four compartments. One each of the tubes 102, tanks 103, optical sensors 113, protruding parts 114, and connector 130 is provided in each compartment of the partitioned interior space 104. Note that the number of compartments in the interior space 104 is not limited to four.

<Tubes 102>

The tube 102 shown in FIG. 2 is a cylindrically shaped member formed of a resin. As shown in FIG. 2, the tubes 102 are located in a lower portion of the end wall 57 constituting the cartridge holder 101. The tubes 102 protrude farther rearward than the end wall 57 of the cartridge holder 101. A rear end (distal end) and a front end (proximal end) of each tube 102 are both open.

The tube 102 has an interior space 102A. A valve 115 and a coil spring 116 are accommodated in the interior space 102A. By moving in the front-rear direction, the valve 115 opens and closes an opening 102B formed in the distal end of the tube 102. The coil spring 116 urges the valve 115 rearward. Hence, when an external force is not being applied to the valve 115 (when the ink cartridge 30 is not mounted in the cartridge-attachment portion 110), the valve 115 closes the opening 102B. Further, when an external force is not being applied to the valve 115, a rear end of the valve 115 urged by the coil spring 116 protrudes rearward from the opening 102B.

Notches (not shown) are formed in a peripheral wall of the tube 102 at the distal end thereof, and specifically in a portion of the peripheral wall positioned rearward from a part of the valve 115 that closes the opening 102B, i.e., a front end of the valve 115.

<Shaft 145>

As shown in FIG. 2, the shaft 145 extends in the left-right direction near the top wall 58 of the cartridge holder 101 and near the opening 112. The shaft 145 is a rod-shaped member that extends in the left-right direction through the interior space 104 of the cartridge holder 101. The shaft 145 is a metal rod, for example. Left and right ends of the shaft 145 are fixed to the side walls 60 of the cartridge holder 101.

<Cover 111>

As shown in FIG. 1, the cover 111 is provided near the opening 112 formed in the cartridge holder 101. The cover 111 is capable of covering the opening 112 or exposing the opening 112 to the outside by closing and opening on the cartridge holder 101. The cover 111 is supported on a pivot shaft 109 that extends in the left-right direction near a portion of the cartridge holder 101 defining a bottom edge of the opening 112. With this construction, the cover 111 is capable of pivoting from a closed position (see FIG. 1) for covering the opening 112 to an open position so that a top edge of the cover 111 moves forward. When the cover 111 is in the open position, the user can insert ink cartridges 30 into the cartridge holder 101 through the opening 112 formed in the cartridge holder 101. When the cover 111 is in the closed position, the user cannot insert ink cartridges 30 into or extract ink cartridges 30 from the cartridge holder 101.

<Tanks 103>

As shown in FIG. 2, the tanks 103 are provided frontward of the cartridge holder 101. Each tank 103 has a box shape and can accommodate ink internally. The tank 103 has a top portion that is open to the outside through an air communication port 124. Accordingly, the interior of the tank 103 is open to the atmosphere. The interior space in the tank 103 is in communication with the front end of the corresponding tube 102 via the corresponding ink tube 20. With this arrangement, ink flowing out of the interior space 102A of the tube 102 is accumulated in the tank 103. The interior space of the tank 103 is also in communication with the recording head 21 via the corresponding ink tube 20. Accordingly, ink stored in the interior of the tank 103 is supplied to the recording head 21 through the corresponding ink tube 20.

Note that the cartridge-attachment portion 110 need not be provided with the tanks 103. In this case, the front ends of the tubes 102 communicate with the recording head 21 via the ink tubes 20 without passing through the tanks 103.

<Optical Sensors 113>

As shown in FIG. 2, the optical sensors 113 are disposed near the top wall 58 of the cartridge holder 101. The optical sensors 113 are positioned farther forward than the shaft 145 in the front-rear direction. Each optical sensor 113 includes a light-emitting part and a light-receiving part. The light-emitting part is disposed on the right or left of the light-receiving part with a gap formed therebetween. The light-emitting part is configured to emit light toward the light-receiving part in the left-right direction.

The optical sensors 113 is configured to output detection signals to a controller 1 (see FIG. 1). The signals differ according to whether the corresponding light-receiving part receives light emitted from the corresponding light-emitting part. For example, the optical sensor 113 outputs a low level signal to the controller 1 when the light-receiving part cannot receive light emitted from the light-emitting part (that is, when the received light is less than a prescribed intensity) and outputs a high level signal to the controller 1 when the light-receiving part can receive light emitted from the light-emitting part (that is, when the received light is greater than or equal to the prescribed intensity). Here, the controller 1 is a device for controlling operations of the printer 10 and is configured of a CPU, ROM, and RAM, for example.

<Cover Sensor 118>

The cover sensor 118 is disposed on the cartridge holder 101 near the top edge of the opening 112. The cover sensor 118 includes a light-emitting part and a light-receiving part. When the cover 111 is in the closed position, a part of the cover 111 is disposed in an optical path of the light traveling from the light-emitting part toward the light-receiving part, blocking the light from reaching the light-receiving part in the cover sensor 118. Accordingly, the cover sensor 118 outputs a low level signal to the controller 1. When the cover 111 is not in the closed position, that is, when the cover 111 is in a position separated from the cover sensor 118, the cover 111 does not interrupt light traveling from the light-emitting part to the light-receiving part, and the cover sensor 118 outputs a high level signal to the controller 1.

<Protruding Parts 114>

As shown in FIG. 2, the protruding parts 114 protrude downward from the top wall 58 of the cartridge holder 101. The protruding parts 114 are disposed rearward of the corresponding optical sensors 113 and forward of the shaft 145 in the front-rear direction.

<Connectors 130>

Figure 3A:
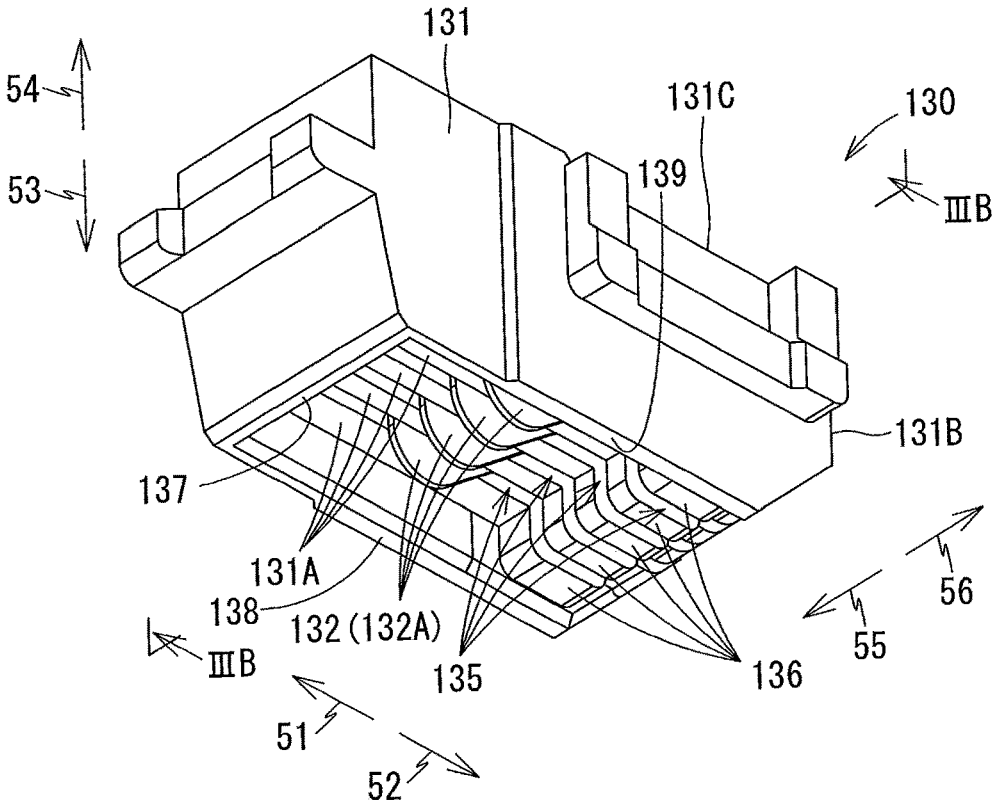
FIG. 3A is a perspective view of a connector of the cartridge-attachment section according to the embodiment.
Figure 3B:
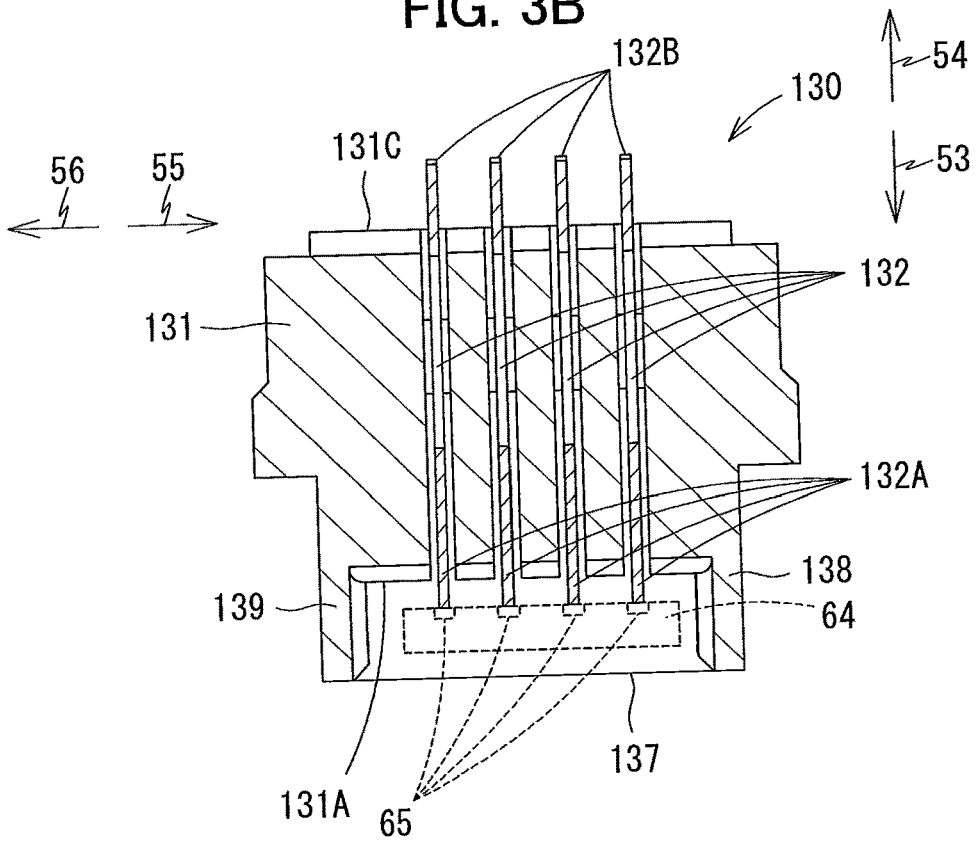
FIG. 3B is a cross-sectional view of the connector according to the embodiment taken along a plane IIIB-IIIB shown in FIG. 3A.

As shown in FIGS. 2 through 3B, each of the connectors 130 includes contacts 132, and a case 131 accommodating the contacts 132.

As shown in FIG. 2, a circuit board 133 is fixed to the cartridge holder 101 in proximity to the top wall 58. The circuit board 133 is positioned farther rearward than the tubes 102 and optical sensors 113 and farther forward than the shaft 145 and protruding parts 114. The circuit board 133 is fixed to the cartridge holder 101. The cases 131 of the connectors 130 are fixed to a bottom surface of the circuit board 133 with screws, solder, or the like (not shown). Hence, the connectors 130 are fixed to the cartridge holder 101 via the circuit board 133. Note that the connectors 130 need not be fixed to the cartridge holder 101. For example, the connectors 130 may be removably fitted into or otherwise attached to the bottom surface of the circuit board 133.

As shown in FIGS. 3A and 3B, the case 131 of each connector 130 has a general rectangular parallelepiped shape. Slots 135 are formed in the case 131 from a bottom surface 131A to a top surface 131C. The slots 135 also pass through a rear surface 131B of the case 131. Four of the slots 135 are formed at intervals in the left-right direction. The four slots 135 provide four internal spaces in the case 131. A single contact 132 is disposed in each of the four internal spaces. Thus, the connector 130 includes four contacts 132. Note that the number of slots 135 is not limited to four. That is, the number of contacts 132 provided in the connector 130 is not limited to four.

The case 131 supports the contacts 132 in the corresponding internal spaces formed by the slots 135. The contacts 132 are configured of members that are flexible and electrically conductive. Bottom ends 132A of the contacts 132 protrude farther downward than the bottom surface 131A of the case 131. The bottom ends 132A of the contacts 132 can be elastically deformed upward.

Top ends 132B of the contacts 132 (see FIG. 3B) are mounted on the circuit board 133. Through this construction, the contacts 132 are electrically connected to an electric circuit mounted on the same circuit board 133. In other words, electricity can be conducted between the contacts 132 and the electric circuit. This electric circuit is also electrically connected to the controller 1 (see FIG. 1).

The case 131 also includes a rear wall 136, a front wall 137, a right wall 138, and a left wall 139. The rear wall 136, front wall 137, right wall 138, and left wall 139 protrude downward from the bottom surface 131A of the case 131. Bottom edges of the rear wall 136, front wall 137, right wall 138, and left wall 139 are thus positioned lower than bottom edges of the contacts 132. Note that one or more of the rear wall 136, front wall 137, right wall 138, and left wall 139 may be omitted from the case 131.

The rear wall 136 is positioned farther rearward than the bottom ends 132A of the contacts 132. The front wall 137 is positioned farther forward than the bottom ends 132A of the contacts 132. The rear wall 136 and front wall 137 are aligned with each other in the front-rear direction. The right wall 138 is positioned farther rightward than the bottom ends 132A of the contacts 132, and the left wall 139 is positioned farther leftward than the bottom ends 132A of the contacts 132. The right wall 138 and left wall 139 are aligned with each other in the left-right direction. A front edge of the right wall 138 is connected to a right edge of the front wall 137, and a rear edge of the right wall 138 is connected to a right edge of the rear wall 136. A front edge of the left wall 139 is connected to a left edge of the front wall 137, and a rear edge of the left wall 139 is connected to a left edge of the rear wall 136.

<Ink Cartridge 30>

Figure 4:
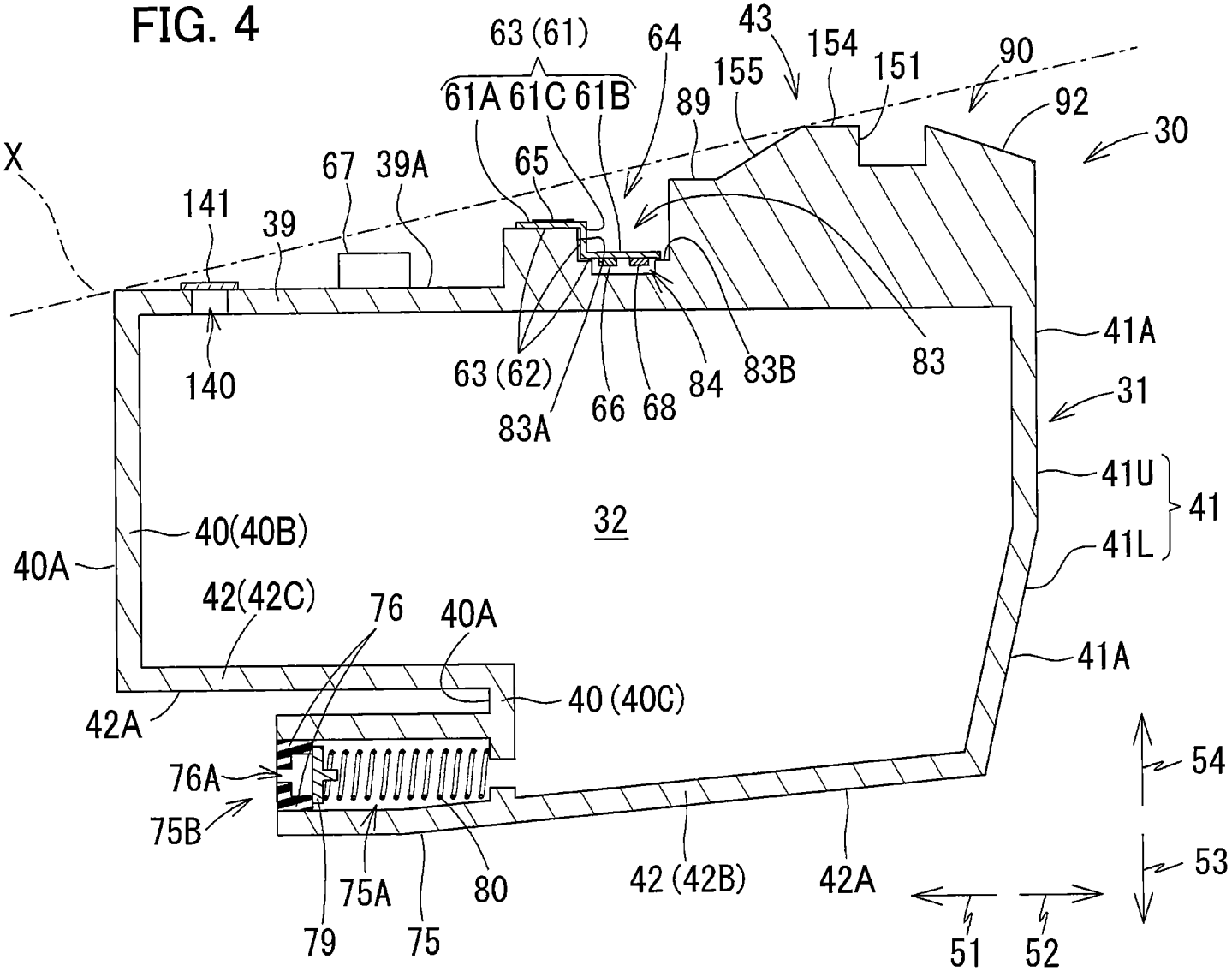
FIG. 4 is a vertical cross-sectional view of an ink cartridge according to the embodiment in an upright posture.
Figure 5B:
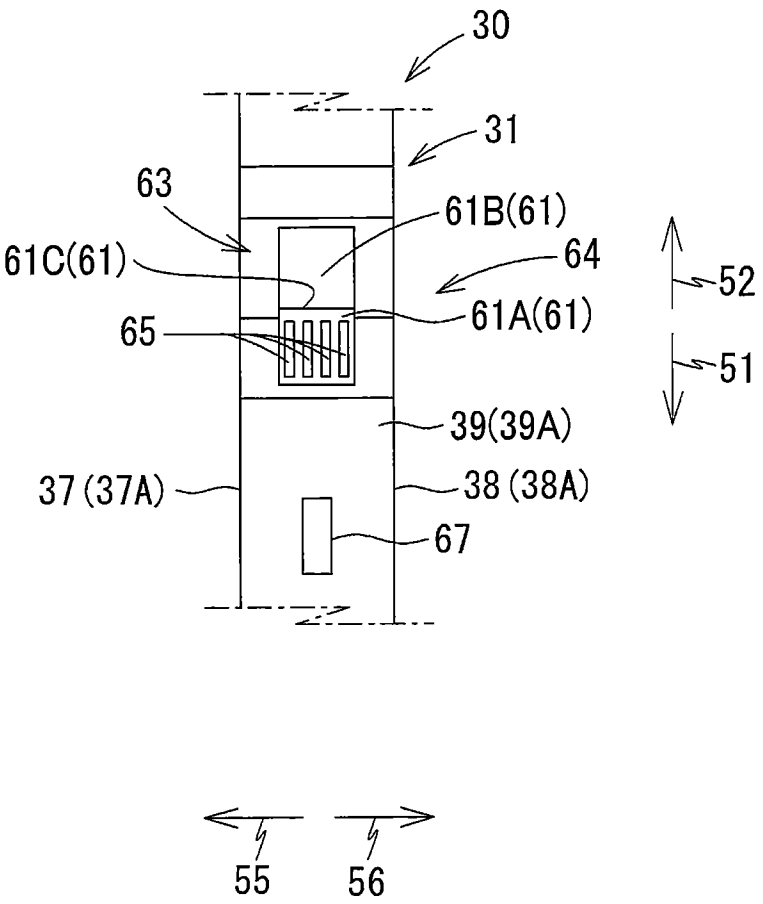
FIG. 5B is a partially-enlarged plan view of the ink cartridge according to the embodiment in the upright posture.
Figure 5A:
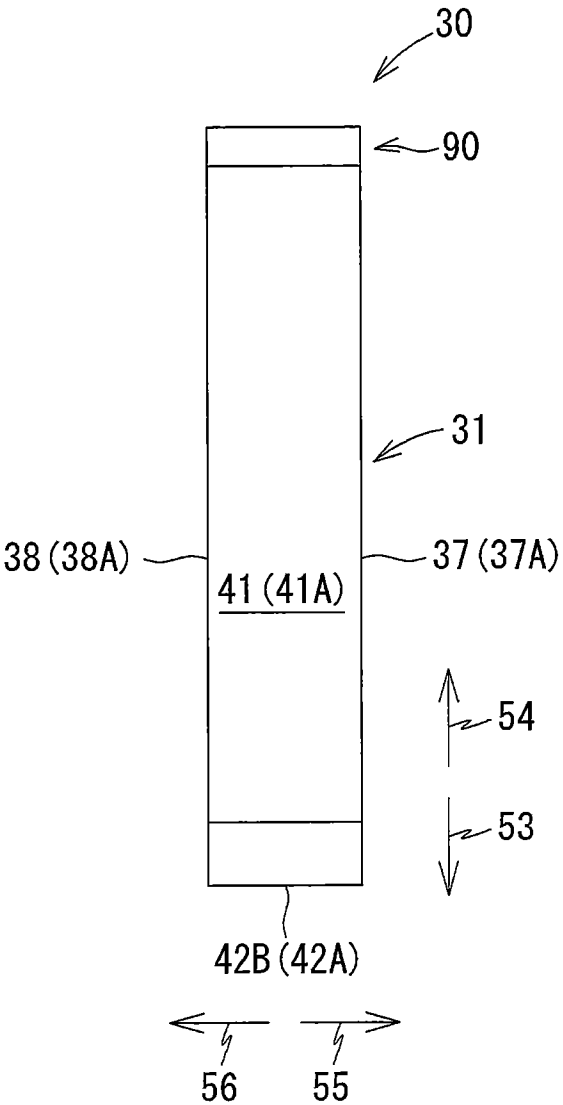
FIG. 5A is a rear side view of the ink cartridge according to the embodiment in the upright posture.
Figure 6:
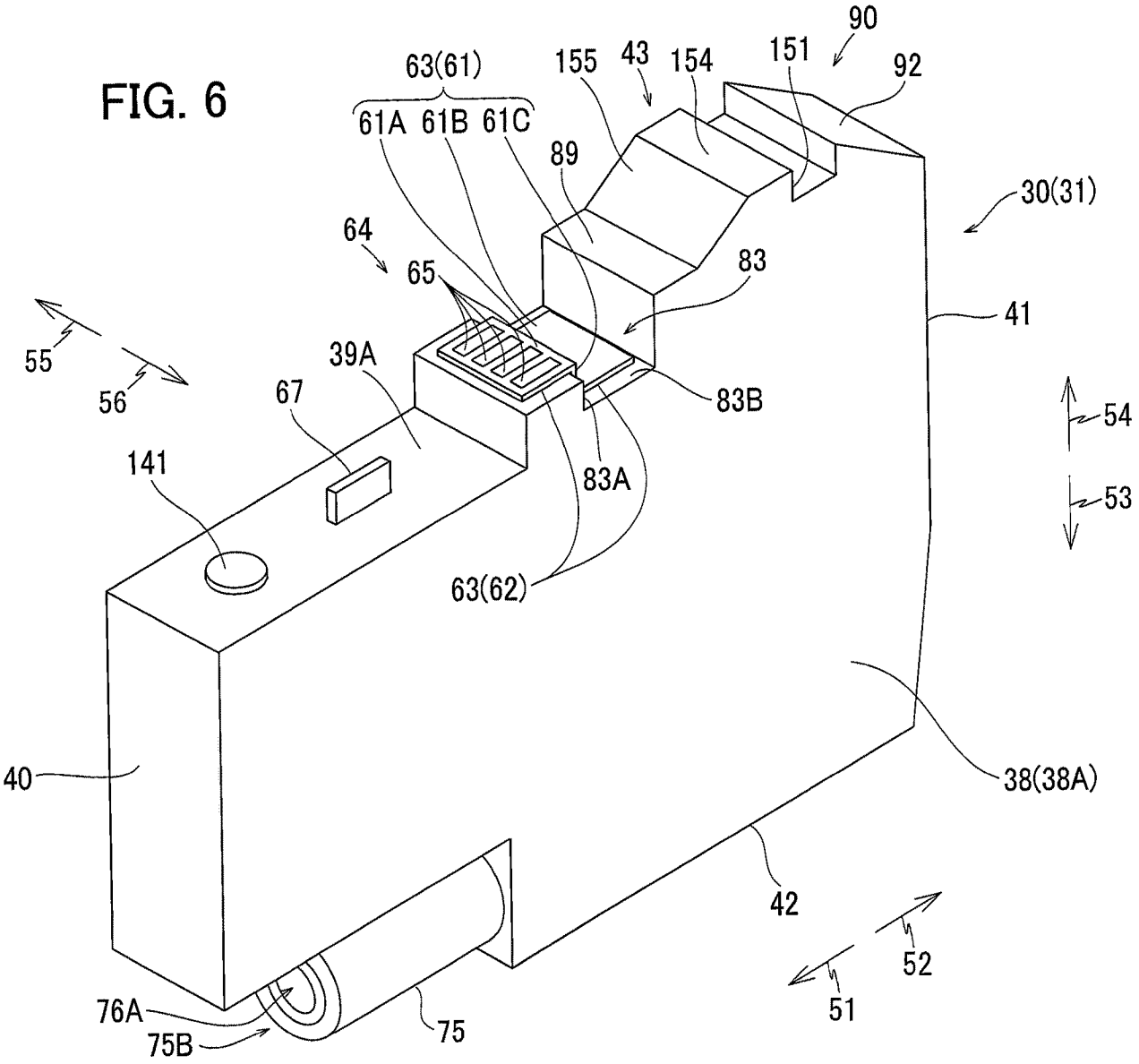
FIG. 6 is a perspective view of the ink cartridge according to the embodiment.

The ink cartridge 30 shown in FIGS. 4 to 6 is a container that stores ink. One ink cartridge 30 is accommodated in each of the four compartments partitioned in the interior space 104 of the cartridge holder 101 (see FIG. 2). Thus, four ink cartridges 30 can be accommodated in the cartridge-attachment portion 110 in the present embodiment. Each of the four ink cartridges 30 corresponds to one of the ink colors cyan, magenta, yellow, and black. Ink in one of these colors is stored in the corresponding ink cartridge 30. Note that the number of ink cartridges 30 that the cartridge-attachment portion 110 can accommodate is not limited to four.

As shown in FIGS. 4 to 6, the ink cartridge 30 includes a housing 31, a sealing member 76, a protruding part 43, an operating part 90, a projection 67, and a circuit board 64.

<Housing 31>

The housing 31 is configured of a front wall 40, a rear wall 41, a top wall 39, a bottom wall 42, and a pair of side walls 37 and 38. The front wall 40 and rear wall 41 are separated from each other in the front-rear direction. The top wall 39 is arranged between the front wall 40 and rear wall 41 and extends from a top edge of the front wall 40 to a top edge of the rear wall 41. The bottom wall 42 is arranged between the front wall 40 and rear wall 41 and extends from a bottom edge of the front wall 40 to a bottom edge of the rear wall 41. The top wall 39 and bottom wall 42 are separated from each other in the direction of gravity. The side wall 37 and side wall 38 are separated from each other in the left-right direction. Peripheral edges of the side walls 37 and 38 are connected to the front wall 40, rear wall 41, top wall 39, and bottom wall 42.

In a state where the ink cartridge 30 is in its upright posture, a direction from the rear wall 41 to the front wall 40 is equivalent to the frontward direction 51, a direction from the front wall 40 to the rear wall 41 is equivalent to the rearward direction 52, a direction from the top wall 39 to the bottom wall 42 is equivalent to the downward direction 53, a direction from the bottom wall 42 to the top wall 39 is equivalent to the upward direction 54, a direction from the side wall 38 to the side wall 37 is equivalent to the rightward direction 55, and a direction from the side wall 37 to the side wall 38 is equivalent to the leftward direction 56. Also in this upright posture, a front surface 40A of the front wall 40 faces forward, a rear surface 41A of the rear wall 41 faces rearward, a bottom surface 42A of the bottom wall 42 faces downward, a top surface 39A of the top wall 39 faces upward, a right surface 37A of the side wall 37 faces rightward, and a left surface 38A of the side wall 38 faces leftward.

The front wall 40 is configured of a front wall 40B, and a front wall 40C positioned farther rearward than the front wall 40B. That is, a front surface of the front wall 40B and a front surface of the front wall 40C constitute the front surface 40A of the front wall 40.

The bottom wall 42 is configured of a bottom wall 42B, and a bottom wall 42C positioned higher than the bottom wall 42B. A bottom surface of the bottom wall 42B and a bottom surface of the bottom wall 42C constitute the bottom surface 42A of the bottom wall 42. The bottom wall 42C extends continuously rearward from a bottom edge of the front wall 40B. The bottom wall 42B and bottom wall 42C are joined through the front wall 40C. The bottom surface of the bottom wall 42B is positioned higher than the bottom of a cylinder 75 described later. The bottom surface of the bottom wall 42B is a sloped surface that slopes relative to the front-rear direction so that its front edge is lower than its rear edge.

The rear wall 41 is configured of an upper portion 41U, and a lower portion 41L. The upper portion 41U is positioned above the lower portion 41L. The lower portion 41L is positioned farther forward than the upper portion 41U. Both the upper portion 41U and lower portion 41L are flat surfaces. The upper portion 41U and lower portion 41L extend in directions that intersect but are not orthogonal to each other. The lower portion 41L slopes relative to the vertical direction, and specifically slopes forward from top to bottom.

Unless otherwise specified, it will be assumed that the ink cartridge 30 is in its upright posture in the following description. In other words, the vertical, front-rear, and left-right directions for the ink cartridge 30 are defined based on the ink cartridge 30 being in the upright posture.

The ink cartridge 30 has an overall flattened shape in which a left-right dimension thereof (width) is smaller than a front-rear dimension thereof (depth), and the vertical and front-rear dimensions (height and depth) are larger than the left-right dimension (width).

The ink cartridge 30 is mounted in the cartridge holder 101 by inserting the ink cartridge 30 forward through the opening 112 formed in the cartridge holder 101 of the cartridge-attachment portion 110 and is removed from the cartridge holder 101 by pulling the ink cartridge 30 rearward through the opening 112.

As shown in FIG. 4, the housing 31 defines therein a storage chamber 32 for storing ink. The storage chamber 32 is positioned between the front wall 40 and rear wall 41, between the top wall 39 and bottom wall 42, and between the pair of side walls 37 and 38. In the present embodiment, the storage chamber 32 is defined by a surface of the front wall 40 opposite the front surface 40A (rear surface of the front wall 40), a surface of the rear wall 41 opposite the rear surface 41A (front surface of the rear wall 41), a surface of the top wall 39 opposite the top surface 39A (lower surface of the top wall 39), and a surface of the bottom wall 42 opposite the bottom surface 42A (upper surface of the bottom wall 42).

In the housing 31, at least the rear wall 41 has a light-transmission capability so that a level of ink stored in the storage chamber 32 is visible from the outside.

The housing 31 includes the cylinder 75 that protrudes forward from the front surface of the front wall 40C. The cylinder 75 is elongated in the front-rear direction. A passage 75A extending in the front-rear direction is formed inside the cylinder 75. That is, the direction in which the cylinder 75 and passage 75A extend (front-rear direction) is aligned with the insertion direction of the ink cartridge 30. An opening 75B is formed in a front end of the cylinder 75 and in communication with the passage 75A. The passage 75A has a rear end in communication with the storage chamber 32. That is, the passage 75A is open at its rear end on the front surface of the front wall 40C. In other words, the passage 75A is open frontward at the front wall 40. Hence, the passage 75A penetrates the front wall 40.

The passage 75A accommodates a valve 79, and a coil spring 80. The valve 79 opens and closes the opening 75B by moving in the front-rear direction. The coil spring 80 urges the valve 79 rearward. Therefore, when an external force is not applied to the valve 79, the valve 79 firmly contacts the sealing member 76 fitted in the opening 75B. However, when an external force is applied to the valve 79, the valve 79 separates from the sealing member 76, allowing ink stored in the storage chamber 32 to be supplied through the passage 75A and out through the opening 75B in the cylinder 75. Note that a structure for switching opening and closing of the opening 75B is not limited to the structure configured of the valve 79. For example, the opening 75B may be closed by a seal adhered to the cylinder 75.

An air communication port 140 is formed in the top wall 39 of the housing 31. A seal 141 seals the air communication port 140 prior to the ink cartridge 30 being inserted into the cartridge-attachment portion 110. The seal 141 can be peeled off the air communication port 140. By peeling the seal 141 off the air communication port 140 before inserting the ink cartridge 30 into the cartridge-attachment portion 110, the storage chamber 32 is able to communicate with the external air via the air communication port 140. Note that communication between the storage chamber 32 and external air may be achieved through means not involving peeling off the seal 141. For example, a valve may be provided in the air communication port 140, and the valve may be used to switch communication between the storage chamber 32 and the outside air on and off.

The front wall 40, rear wall 41, top wall 39, bottom wall 42, and side walls 37 and 38 may be configured of a plurality of walls in the same manner as the front wall 40 in the embodiment, or may be configured of single walls in the manner of the rear wall 41.

Further, the surfaces of the ink cartridge 30 including the front surface 40A of the front wall 40, rear surface 41A of the rear wall 41, top surface 39A of the top wall 39, bottom surface 42A of the bottom wall 42, right surface 37A of the side wall 37, and left surface 38A of the side wall 38 need not be formed as single flat surfaces.

The front surface 40A of the front wall 40 is a surface of the housing 31 that is visible when viewing the ink cartridge 30 in its upright posture from the front side. According to a concept of the present disclosure, a front surface includes: a surface of the housing 31 positioned farthest forward (the front surface 40A); and a surface positioned forward of a halfway point in the front-rear direction between the forwardmost surface and a rearmost surface of the housing 31 (the rear surface 41A).

The rear surface 41A of the rear wall 41 is a surface of the housing 31 that is visible when viewing the ink cartridge 30 in its upright posture from the rear side. The concept of a rear surface in the present disclosure includes: a surface of the housing 31 positioned farthest rearward (the rear surface 41A); and a surface positioned rearward of the halfway point in the front-rear direction between the rearmost surface and the forwardmost surface of the housing 31 (front surface 40A).

The top surface 39A of the top wall 39 is a surface of the housing 31 that is visible when viewing the ink cartridge 30 in its upright posture from above. The concept of the top surface in the present disclosure includes: a topmost surface of the housing 31 (the top surface 39A); and a surface above a vertical halfway point between this topmost surface and a bottommost surface of the housing 31 (the bottom surface 42A).

The bottom surface 42A of the bottom wall 42 is a surface of the housing 31 that is visible when viewing the ink cartridge 30 in its upright posture from below. The concept of the bottom surface in the present disclosure includes: the bottommost surface of the housing 31 (the bottom surface 42A); and a surface below the vertical halfway point between this bottommost surface and the topmost surface of the housing 31 (the top surface 39A).

The right surface 37A of the side wall 37 is a surface of the housing 31 that is visible when viewing the ink cartridge 30 in its upright posture from the right side.

The left surface 38A of the side wall 38 is a surface of the housing 31 that is visible when viewing the ink cartridge 30 in its upright posture from the left side.

<Sealing Member 76>

The sealing member 76 shown in FIG. 4 is configured of an elastic member formed of rubber or the like. The sealing member 76 is a ring-shaped member with a circular through-hole 76A formed in a center thereof. The through-hole 76A has a diameter smaller than an outer diameter of the tube 102 in the cartridge-attachment portion 110 (see FIG. 2). As shown in FIG. 4, the sealing member 76 is disposed near the opening 75B of the cylinder 75 so that the through-hole 76A is at the same position as the opening 75B in the front-rear direction. The sealing member 76 has an outer diameter larger than a diameter of the opening 75B. Accordingly, when the sealing member 76 is fitted into the opening 75B, a hermetic seal is formed between the sealing member 76 and the cylinder 75 to provide a light-tight seal therebetween.

The sealing member 76 is prevented from coming out of the cylinder 75 by well-known means. For example, the sealing member 76 may be fixed in the cylinder 75 by interposing the sealing member 76 between the cylinder 75 and a cap (not shown) placed over the cylinder 75, or may be fixed in the cylinder 75 by adhesive.

<Protruding Part 43>

As shown in FIG. 4, the protruding part 43 is provided on a rear portion of the top surface 39A of the top wall 39. The protruding part 43 protrudes upward and is elongated in the front-rear direction. The protruding part 43 has a rear end face 151 facing rearward which serves as a lock surface 151.

The protruding part 43 also includes a horizontal surface 154 that extends continuously forward from the lock surface 151. The horizontal surface 154 expands in both the left-right and front-rear directions. The protruding part 43 also includes a sloped surface 155 that is forward of and continuous with the horizontal surface 154. The sloped surface 155 slopes relative to the front-rear direction, and specifically slopes downward toward the front.

The protruding part 43 also includes a positioning surface 89. The positioning surface 89 is formed frontward of the sloped surface 155. The positioning surface 89 faces upward.

<Operating Part 90>

As shown in FIG. 4, the operating part 90 is formed on the top wall 39 at a position rearward of the lock surface 151. The operating part 90 has an operating surface 92. The user operates the operating part 90 in order to pull the ink cartridge 30 mounted in the cartridge holder 101 rearward.

<Projection 67>

As shown in FIG. 4, the projection 67 is provided on the top surface 39A of the top wall 39. The projection 67 protrudes upward from the top surface 39A and is elongated in the front-rear direction. The projection 67 is positioned forward of the positioning surface 89. When viewed in the left-right direction, the projection 67 is positioned lower than a virtual plane X that is the highest among virtual planes passing through the upper-front corner of the housing 31 and the protruding part 43.

Light emitted by the optical sensor 113 of the cartridge-attachment portion 110 (see FIG. 2) is incident on either a right surface or a left surface of the projection 67. The surface of the projection 67 on which light is incident will be called a "light-blocking surface". In the present embodiment, the projection 67 is a plate formed of a resin material that contains a color material (black pigment) capable of blocking or absorbing light, for example. As a variation, a material that prevents the passage of light such as aluminum foil may be affixed to at least the light-blocking surface of the projection 67.

<Circuit Board 64>

As shown in FIG. 4, a recess 83 is formed in the top surface 39A of the top wall 39. The recess 83 is positioned rearward of the projection 67 and forward of the positioning surface 89 in the front-rear direction. The circuit board 64, and more accurately a substrate 63, is supported from below by a portion of the top surface 39A along the periphery of the recess 83.

The circuit board 64 includes the substrate 63, a memory 66, a battery 68, and electrodes 65. The circuit board 64 is positioned rearward of the projection 67 and forward of the protruding part 43. The circuit board 64 is also positioned farther rearward than the sealing member 76 in the front-rear direction. More specifically, the circuit board 64 is positioned farther rearward than the through-hole 76A formed in the sealing member 76. The circuit board 64 is also positioned below the virtual plane X described above in the vertical direction. The storage chamber 32 is vertically interposed between the circuit board 64 and the bottom surface 42A of the bottom wall 42.

The substrate 63 of the circuit board 64 is a flexible substrate formed of a plastic film or the like. The circuit board 64 is configured by mounting the memory 66 and battery 68 on the substrate 63 and forming four electrodes 65 on the substrate 63 (see FIG. 5B).

Note that the number of electrodes 65 is determined based on the number of the contacts 132 in the cartridge-attachment portion 110 (see FIG. 2) and is not limited to four. Further, the battery 68 need not be mounted on the circuit board 64.

The substrate 63 has a length in the front-rear direction that is greater than a width thereof in the left-right direction. Preferably, the front-rear dimension of the substrate 63 is at least two times greater than the left-right dimension, and more preferably at least three times greater than the left-right dimension. Note that the front-rear dimension of the substrate 63 may be less than two times the left-right direction or even less than or equal to the left-right dimension.

The substrate 63 has a first surface 61, and a second surface 62. The first surface 61 is exposed to the outside of the ink cartridge 30. The second surface 62 is a surface opposite the first surface 61 and is fixed to the top surface 39A of the top wall 39 of the housing 31.

The substrate 63 is bonded to the top surface 39A with a photopolymer. However, the circuit board 64 may be bonded to the top surface 39A with an adhesive other than a photopolymer or may be mounted on the top surface 39A by means other than adhesives, such as thermal caulking. Note that when thermal caulking is used to mount the circuit board 64 on the top surface 39A, each of the four corners of the circuit board 64 is preferably fixed to the top surface 39A; that is, each of the right-front corner, left-front corner, right-rear corner, and left-rear corner in a plan view. However, it should be obvious that the positions subjected to the thermal caulking need not be limited to these four corners.

The substrate 63 extends into the recess 83 from a position forward of the recess 83. The second surface 62 follows the shape of the recess 83 on the top surface 39A. With this arrangement, the first surface 61 of the substrate 63 is divided into a first region 61A, a second region 61B, and a step 61C.

The first region 61A constitutes a portion of the first surface 61 positioned forward of the recess 83. The first region 61A faces at least upward. Specifically, the first region 61A in the present embodiment faces in a direction directly opposite the direction of gravity when the ink cartridge 30 is in the upright posture. The first region 61A extends in both front-rear and left-right directions. Note that the first region 61A may extend in directions inclined relative to the front-rear and left-right directions.

The second region 61B is a portion of the first surface 61 extending in the front-rear direction along the bottom of the recess 83. The second region 61B is positioned lower than and rearward of the first region 61A. The second region 61B extends along a bottom surface 83B defining the recess 83. The second region 61B faces at least upward. Specifically, in the present embodiment, the second region 61B faces in the direction directly opposite the direction of gravity when the ink cartridge 30 is in the upright posture. The second region 61B extends in both front-rear and left-right directions. Note that the second region 61B may extend in directions inclined relative to the front-rear and left-right directions.

The step 61C is a portion of the first surface 61 between the first region 61A and second region 61B. The step 61C extends along a side surface 83A defining the recess 83. In other words, the step 61C defines part of the recess 83. A top edge of the step 61C is continuous with a rear edge of the first region 61A, while a bottom edge of the step 61C is continuous with a front edge of the second region 61B. Hence, the second region 61B is connected to the first region 61A via the step 61C. The step 61C faces at least rearward. Specifically, the step 61C in the present embodiment faces in a direction opposite the insertion direction when the ink cartridge 30 is in its upright posture. Note that the step 61C may extend in directions sloped relative to the front-rear and left-right directions.

A plurality of electrodes (not shown) is formed on the second surface 62 of the substrate 63 at a region opposite the second region 61B of the first surface 61. The memory 66 is positioned on some of these electrodes. The battery 68 is positioned on the electrodes that the memory 66 is not mounted on. Hence, the memory 66 and battery 68 are mounted on the second surface 62 of the substrate 63 at the region opposite the second region 61B of the first surface 61.

Here, a depression 84 is formed in the bottom surface 83B of the recess 83 at a region corresponding to the region in which the memory 66 and battery 68 are mounted. In other words, the memory 66 and battery 68 mounted on the second surface 62 are positioned in the depression 84.

The memory 66 stores information related to the ink cartridge 30 that can be read by the controller 1 of the printer 10. The information related to the ink cartridge 30 is data specifying a lot number, a manufactured date, an ink color, and the like. The memory 66 may be a semiconductor memory, such as a Static RAM (SRAM). Note that an integrated circuit (IC) providing function(s) other than a memory may also be mounted on the substrate 63, if necessary.

The battery 68 is a button-shaped battery (button cell) in the present embodiment. The battery 68 is positioned rearward of the memory 66. In other words, the battery 68 is mounted at a position separated farther away from the first region 61A than the memory 66 is from the first region 61A in the front-rear direction. The electrodes on which the battery 68 is mounted are connected to the electrodes on which the memory 66 is mounted. With this structure, the battery 68 is electrically connected to the memory 66, whereby the battery 68 is configured to supply electricity to the memory 66. Upon receipt of the power supply from the battery 68, the memory 66 (SRAM) can store various data.

Note that, instead of the battery 68, an electronic component other than the battery 68 may be mounted on the substrate 63 for supplying power to the memory 66. For example, a capacitor in a charged state can be employed as another example of the electronic component for supplying power to the memory 66.

As shown in FIG. 3B, each of the four electrodes 65 formed on the first surface 61 corresponds to one of the four contacts 132 in the cartridge-attachment portion 110. Hence, the number of electrodes 65, as with the number of contacts 132, is not limited to four. As shown in FIG. 5B, the four electrodes 65 are exposed on the first region 61A of the first surface 61 constituting the substrate 63, allowing for electrical connections. Each electrode 65 is elongated in the front-rear direction. The electrodes 65 are arranged parallel to each other and are spaced apart from each other in the left-right direction on the top surface (first surface 61) of the substrate 63. The four electrodes 65 are positioned forward of and lower than the lock surface 151. Each electrode 65 is electrically connected to the memory 66.

The memory 66 and battery 68 are mounted on the second surface 62 at positions lower than the electrodes 65 formed on the first region 61A of the first surface 61 in the upright posture.

<Operations for Attaching the Ink Cartridge 30 to the Cartridge-Attachment Portion 110>

Next, operations for mounting the ink cartridge 30 in the cartridge holder 101 of the cartridge-attachment portion 110 will be described.

FIG. 4 shows the ink cartridge 30 prior to being mounted in the cartridge-attachment portion 110. At this time, the seal 141 seals the air communication port 140 so that the storage chamber 32 is not in communication with the atmosphere. Prior to mounting the ink cartridge 30 in the cartridge-attachment portion 110, the user peels off the seal 141, opening the storage chamber 32 to the atmosphere. Also, prior to the ink cartridge 30 being mounted in the cartridge-attachment portion 110, the valve 79 is in contact with the sealing member 76. Consequently, ink stored in the storage chamber 32 is prevented from flowing out of the ink cartridge 30 through the through-hole 76A.

In a state where the ink cartridge 30 is not attached to the cartridge-attachment portion 110, no member is positioned between the light-emitting part and light-receiving part of the optical sensor 113, enabling light to travel from the light-emitting part to the light-receiving part. At this time, the optical sensor 113 outputs a high level detection signal to the controller 1 (see FIG. 1). Further, prior to attachment of the ink cartridge 30 to the cartridge-attachment portion 110, the valve 115 closes the opening 102B, and the rear end of the valve 115 protrudes rearward from the opening 102B.

Figure 7:
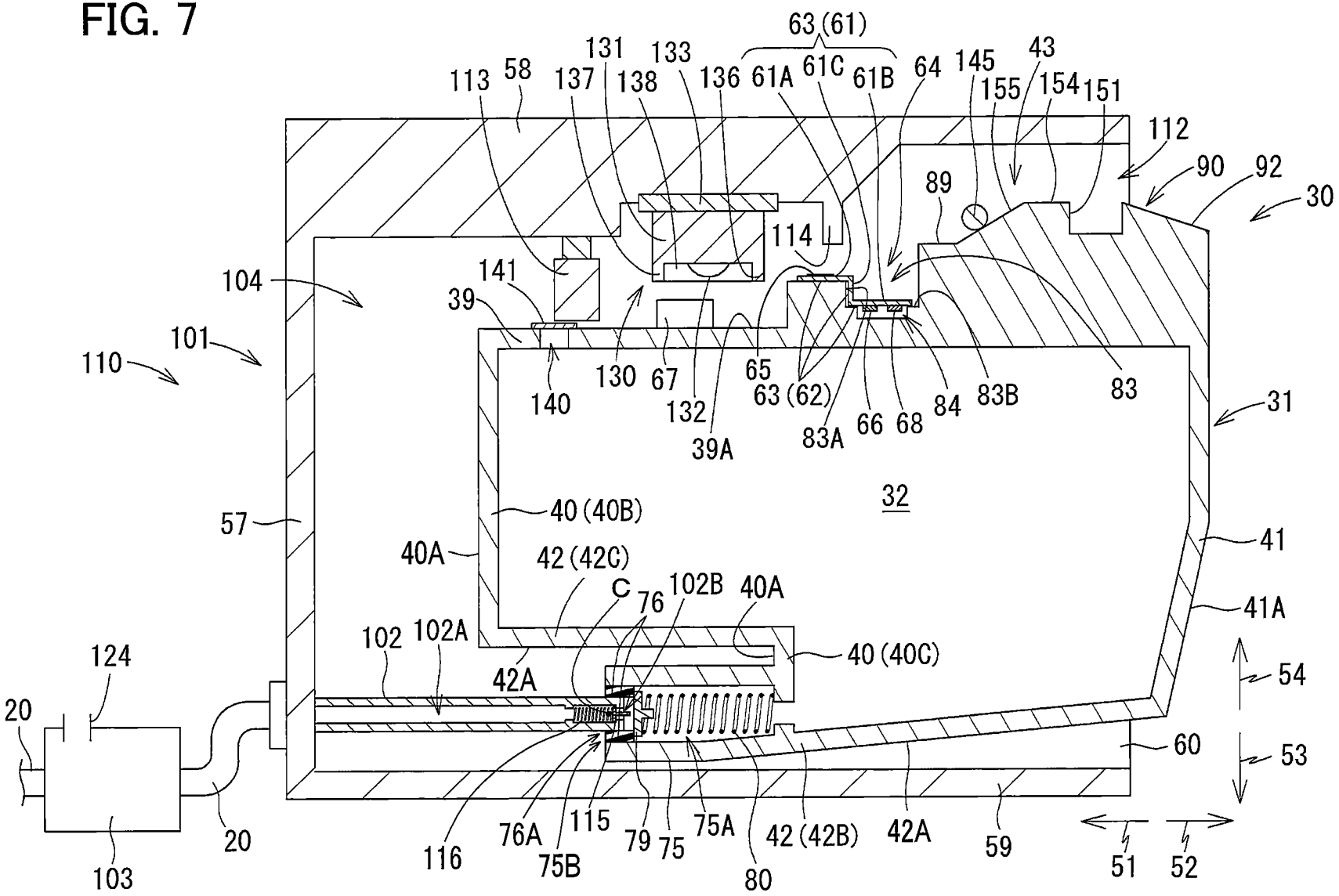
FIG. 7 is a vertical cross-sectional view of the ink cartridge according to the embodiment being inserted into the cartridge-attachment section.

In order to attach the ink cartridge 30 to the cartridge-attachment portion 110, the ink cartridge 30 is inserted forward into the cartridge holder 101 through the opening 112 of the cartridge-attachment portion 110 (see FIG. 7). Note that while the ink cartridge 30 is inserted into the cartridge holder 101 in a state similar to the upright posture in the embodiment, the ink cartridge 30 may instead be inserted into the cartridge holder 101 while tilted relative to the horizontal direction. As shown in FIG. 4, the upper portion 41U of the rear wall 41 is positioned farther rearward than the lower portion 41L. That is, the upper portion 41U is closer to the user than the lower portion 41L is. Hence, the user pushes forward on the upper portion 41U when inserting the ink cartridge 30 into the cartridge holder 101.

As the ink cartridge 30 is inserted forward into the cartridge holder 101, as illustrated in FIG. 7, the tube 102 of the cartridge-attachment portion 110 is inserted into the passage 75A of the cylinder 75 through the through-hole 76A formed in the sealing member 76 (the opening 75B). At this time, the outer circumferential surface of the tube 102 closely contacts an inner circumferential surface of the sealing member 76 (the surface defining the through-hole 76A). This configuration not only fixes the position of the cylinder 75 when the ink cartridge 30 is in its attached state, but also forms a liquid-tight seal between the cylinder 75 and tube 102 that prevents ink from leaking into the cartridge holder 101.

The tube 102 inserted into the passage 75A also contacts and pushes the valve 79 rearward. Through this action, the valve 79 is separated from the sealing member 76 against a forward urging force of the coil spring 80.

Further, when the distal end of the tube 102 contacts the valve 79, the valve 79 contacts the valve 115 from the rear side thereof and pushes the valve 115 forward. Consequently, the valve 115 moves forward against the urging force of the coil spring 116. This action allows the interior space 102A of the tube 102 to communicate with the exterior of the tube 102 through the opening 102B.

As a result, ink stored in the storage chamber 32 can flow into the tank 103 and recording head 21 via the interior space 102A of the tube 102. At this time (in the state shown in FIG. 7), the circuit board 64 is not yet in contact with the cartridge-attachment portion 110.

Also, when the ink cartridge 30 is being inserted forward into the cartridge holder 101, as illustrated in FIG. 7, the sloped surface 155 formed on the protruding part 43 of the ink cartridge 30 contacts the shaft 145 from the rear. The shaft 145 is guided along the sloped surface 155. As the user pushes the upper portion 41U of the rear wall 41 forward, torque (rotational moment) is applied to the ink cartridge 30 in a counterclockwise direction of FIG. 7. However, due to the contact between the sloped surface 155 and shaft 145, the ink cartridge 30 pivots clockwise in FIG. 7 against this torque about a center C of the opening 75B in which the tube 102 is inserted. The position of the center C in the ink cartridge 30 depends on the shape of the tube 102 and the shape of the opening 75B, but a center of an area at which the outer surface of the tube 102 contacts the inner circumferential surface of the sealing member 76 (the surface defining the through-hole 76A) is a hypothetical pivot center. The posture of the ink cartridge 30 at this point (the orientation of the ink cartridge 30 shown in FIG. 8) will be called a pivoted posture.

Forming the bottom wall 42 of the housing 31 as a sloped surface that slopes relative to the front-rear direction provides a space between the bottom wall 42 and an inner top surface of the bottom wall 59 of the cartridge holder 101 needed for this pivotal movement (clockwise pivot).

Figure 8:
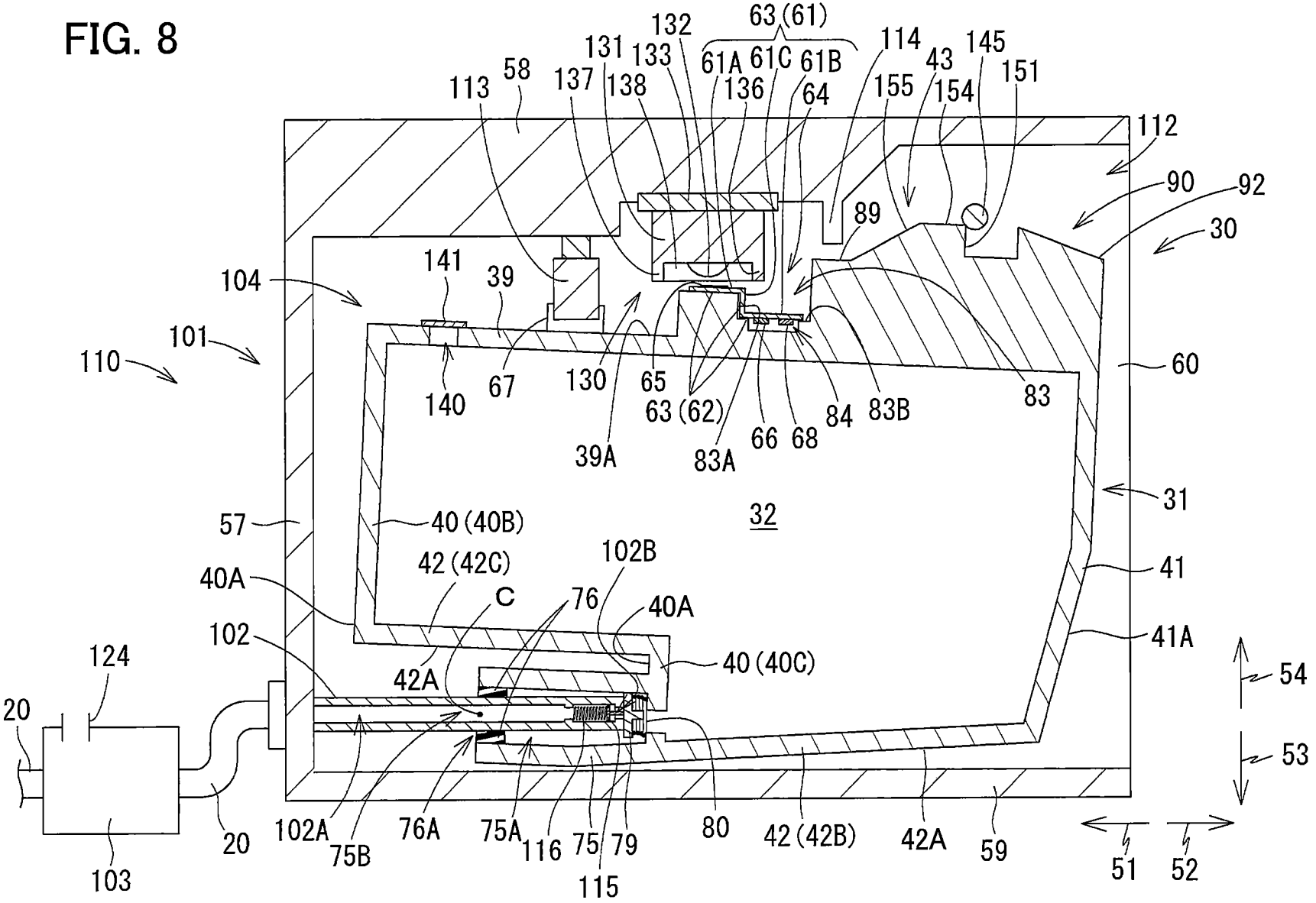
FIG. 8 is a vertical cross-sectional view of the ink cartridge according to the embodiment being inserted into the cartridge-attachment section, the ink cartridge being in a pivoted posture.

As the ink cartridge 30 is inserted farther forward from the state shown in FIG. 7 against the rearward urging force of the coil spring 80, the circuit board 64 arrives at a position beneath the contacts 132 (see FIG. 8). Owing to the pivoting described above, the ink cartridge 30 is tilted such that the circuit board 64 moves below the rear wall 136 of the connector 130, allowing the circuit board 64 to pass forward under the rear wall 136 of the connector 130 until arriving directly below the contacts 132. Also owing to the above pivoting, a vertical gap exists between the electrodes 65 on the circuit board 64 and the contacts 132 when the ink cartridge 30 is in the pivoted posture. In other words, the electrodes 65 are separated from the contacts 132. In addition, the positioning surface 89 arrives below the protruding part 114, but a vertical gap exists between the protruding part 114 and positioning surface 89 while the ink cartridge 30 is in its pivoted posture. In other words, the protruding part 114 is separated from the positioning surface 89.

Further, in the state depicted in FIG. 8, the sloped surface 155 and horizontal surface 154 of the protruding part 43 move to a position farther forward than the shaft 145. When the ink cartridge 30 is in this pivoted posture, the lock surface 151 is below the shaft 145.

As the user continues to push forward on the upper portion 41U of the rear wall 41, torque is applied to the ink cartridge 30 in the counterclockwise direction of FIG. 8. Since the sloped surface 155 and horizontal surface 154 no longer contact the shaft 145, the force applied by the user causes the ink cartridge 30 to pivot counterclockwise in FIG. 8 about the center C against the rearward urging force of the coil spring 80. As a result, the ink cartridge 30 assumes a state shown in FIG. 9, the state of the ink cartridge 30 at this time is the attached state. In the attached state, the cartridge holder 101 retains the ink cartridge 30 in the interior space 104 in the upright posture.

Next, states of components in the ink cartridge 30 and cartridge-attachment portion 110 while the ink cartridge 30 is in the attached state shown in FIG. 9 will be described.

As shown in FIG. 9, the tube 102 of the cartridge-attachment portion 110 has advanced into the passage 75A of the cylinder 75.

By pivoting the ink cartridge 30 shown in FIG. 8 counterclockwise, the positioning surface 89 of the ink cartridge 30 contacts the bottom surface of the protruding part 114 in the cartridge-attachment portion 110 from below. This contact restricts further upward movement of the ink cartridge 30, i.e., restricts the ink cartridge 30 from pivoting farther counterclockwise about the center C. Thus, the ink cartridge 30 is vertically positioned in the cartridge holder 101.

Further, by pivoting the ink cartridge 30 depicted in FIG. 8 counterclockwise, the protruding part 43 moves upward. Through this pivotal movement, the lock surface 151 of the ink cartridge 30 faces rearward and confronts the shaft 145 in the cartridge-attachment portion 110 in the front-rear direction. When the user stops pushing the ink cartridge 30 forward, the ink cartridge 30 is moved rearward by the urging force of the coil spring 80. However, since the rearward-facing lock surface 151 confronts the shaft 145, the lock surface 151 contacts the shaft 145 from the front side thereof as the ink cartridge 30 moves rearward (see FIG. 9). In other words, the lock surface 151 is in contact with the front side of the shaft 145 when the ink cartridge 30 is in the attached state. Hence, the protruding part 43 is engaged with the cartridge holder 101. This engagement restricts further rearward movement of the ink cartridge 30, thereby positioning the ink cartridge 30 in the front-rear direction in the cartridge holder 101.

As shown in FIG. 9, the projection 67 is positioned between the light-emitting part and light-receiving part of the optical sensor 113. Consequently, the projection 67 blocks the progression of light from the light-emitting part to the light-receiving part. That is, the projection 67 is positioned in the optical path of light irradiated from the light-emitting part when the ink cartridge 30 is in the attached state. In other words, the optical sensor 113 is positioned such that the light-blocking surface of the projection 67 is in the optical path of light irradiated from the light-emitting part when the ink cartridge 30 is in the attached state. At this time, the optical sensor 113 outputs a low level detection signal to the controller 1 (see FIG. 1).

Further, as a result of the pivoting of the ink cartridge 30 counterclockwise from the state shown in FIG. 8, the electrodes 65 of the circuit board 64 contact corresponding contacts 132 from below, thereby elastically deforming the contacts 132 upward (see FIG. 9). Thus, when the ink cartridge 30 is in the attached state, the electrodes 65 are electrically connected to the contacts 132 while elastically deforming the contacts 132 upward. With the four electrodes 65 contacting the corresponding contacts 132 so that electricity can be conducted therebetween, a voltage Vc is applied to the electrodes 65, the electrodes 65 are grounded, and power is supplied to the electrodes 65. Through this electrical connection between the contacts 132 and electrodes 65, the memory 66 mounted on the circuit board 64 is also electrically connected to the controller 1 (see FIG. 1). Consequently, the controller 1 can access the memory 66, enabling data stored in the memory 66 to be inputted into the controller 1 (see FIG. 1).

When the ink cartridge 30 is in the attached state shown in FIG. 9, the front wall 137 of the connector 130 is positioned frontward of the circuit board 64, and the rear wall 136 of the connector 130 is positioned rearward of the first region 61A of the substrate 63 constituting the circuit board 64. With this arrangement, the electrodes 65 are interposed between the front wall 137 and rear wall 136 in the front-rear direction when the ink cartridge 30 is in the attached state. That is, the rear wall 136 and front wall 137 are juxtaposed in the front-rear direction with the electrodes 65 interposed therebetween.

Further, a bottom edge of the front wall 137 is positioned lower than the electrodes 65 and higher than the second region 61B. The rear wall 136 overlaps with the second region 61B of the circuit board 64 when viewed from above. In other words, the second region 61B is aligned with the rear wall 136 in the vertical direction. A bottom edge of the rear wall 136 is positioned lower than the electrodes 65 and higher than the second region 61B. In other words, the second region 61B is vertically separated from the bottom edge of the rear wall 136.

Note that while the first region 61A, second region 61B, bottom edge of the rear wall 136, and bottom edge of the front wall 137 all extend in the horizontal direction in the present embodiment, one or more of the first region 61A, second region 61B, bottom edge of the rear wall 136, and bottom edge of the front wall 137 may extend in a direction sloped relative to the horizontal direction.

As shown in FIG. 3B, the right wall 138 of the connector 130 is on the right side of the circuit board 64, and the left wall 139 of the connector 130 is on the left side of the circuit board 64 when the ink cartridge 30 is in the attached state. Further, bottom edges of the right wall 138 and left wall 139 are positioned lower than the electrodes 65. With this configuration, the right wall 138 and left wall 139 enclose the electrodes 65 from the left and right sides when the ink cartridge 30 is in the attached state. That is, the right wall 138 and left wall 139 are juxtaposed in the left-right direction with the electrodes 65 interposed therebetween.

To extract the ink cartridge 30 from the cartridge holder 101 of the cartridge-attachment portion 110, the user pushes the operating surface 92 downward. As shown in FIG. 9, the operating surface 92 faces obliquely upward and rearward when the ink cartridge 30 is in the attached state. Hence, by operating the operating surface 92, the user applies force to the ink cartridge 30 in a direction diagonally downward and forward. This force pivots the ink cartridge 30 clockwise in FIG. 9, causing the positioning surface 89 to separate from the protruding part 114, as illustrated in FIG. 8. Further, the lock surface 151 is moved to a position lower than the shaft 145. In other words, the posture of the ink cartridge 30 is changed from the upright posture to the pivoted posture. Consequently, the urging force of the coil spring 80 moves the ink cartridge 30 rearward relative to the cartridge holder 101. Through the above operation, the user can then remove the ink cartridge 30 from the cartridge-attachment portion 110.

<Detecting Attachment of the Ink Cartridge 30 to the Cartridge-Attachment Portion 110>

Next, operations for detecting when an ink cartridge 30 is inserted into the cartridge-attachment portion 110 will be described with reference to flowcharts shown in FIGS. 10 and 11.

Figure 10:
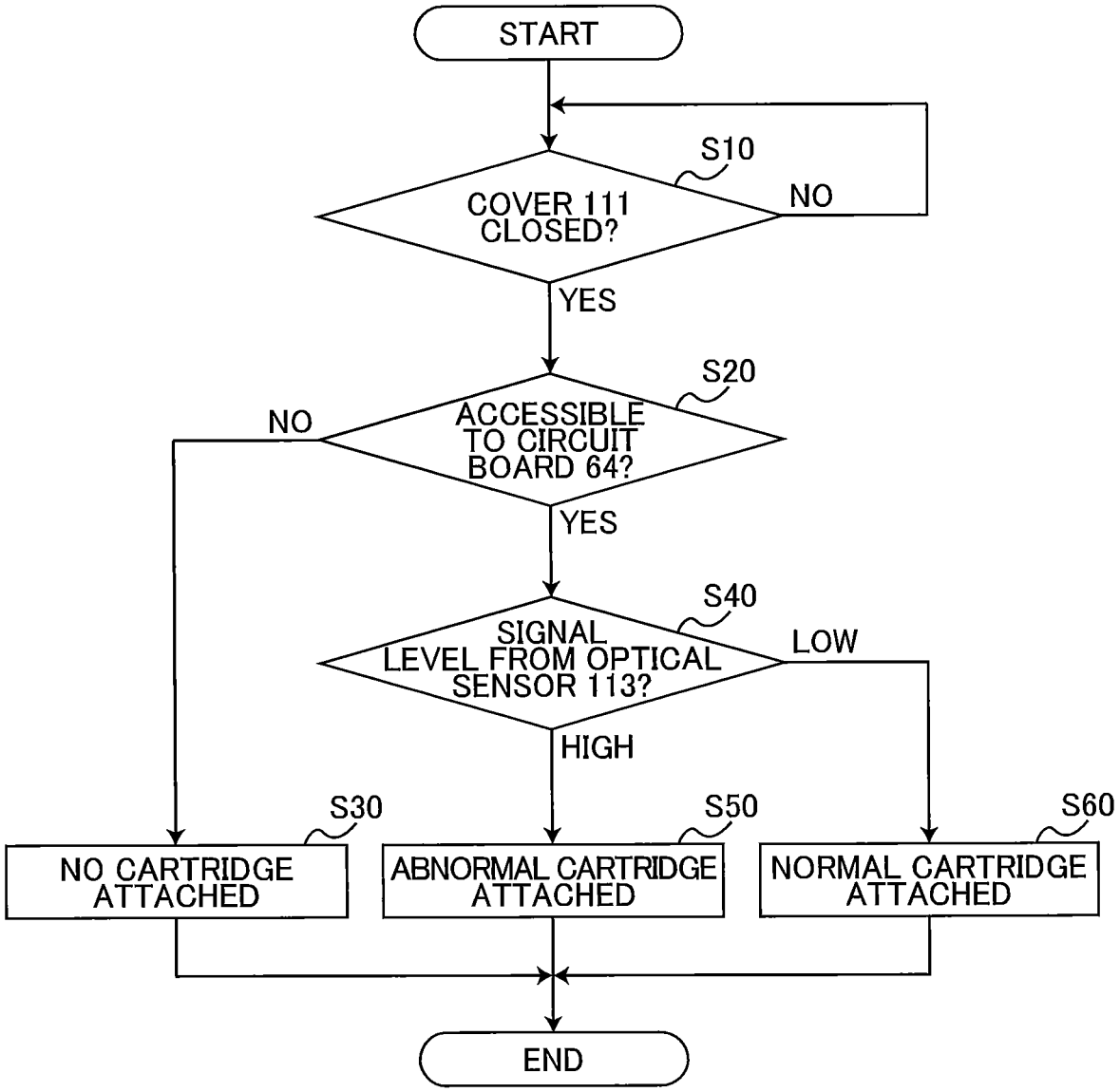
FIG. 10 is a flowchart illustrating steps to determine whether the ink cartridge according to the embodiment is attached to the cartridge-attachment section.
Figure 11:
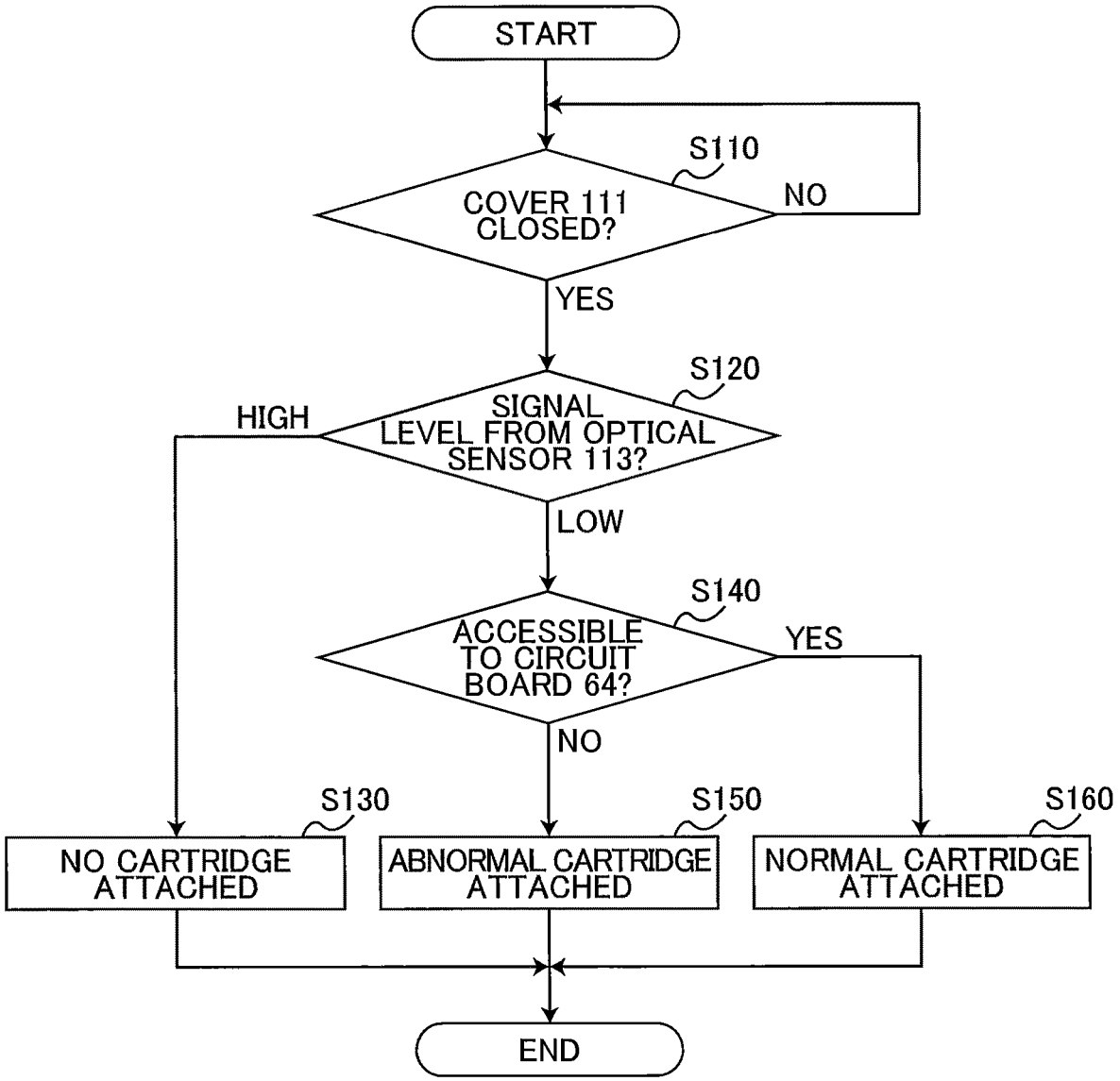
FIG. 11 is a flowchart illustrating another way of determining whether the ink cartridge according to the embodiment is attached to the cartridge-attachment section.

The flowcharts of FIGS. 10 and 11 are configured to be initiated when the cover 111 is opened by the user. That is, the controller 1 is configured to launch the flowchart of FIG. 10 or the flowchart of FIG. 11 in response to receiving a high level signal outputted from the cover sensor 118.

As shown in FIG. 10, in S10 the controller 1 (see FIG. 1) determines whether the cover 111 is in the closed position. The controller 1 determines that the cover 111 is in the closed position when the signal outputted from the cover sensor 118 changes to a low level signal.

In a case where the cover 111 is not in the closed position (S10: NO), the controller 1 repeats the determination in S10 until the cover 111 is determined to be closed, i.e., until the signal outputted from the cover sensor 118 changes from high level to low level.

When the cover 111 is determined to be in the closed position (S10: YES), in S20 the controller 1 determines whether the memory 66 on the circuit board 64 of the ink cartridge 30 is accessible, i.e., whether the controller 1 can read from or write to the memory 66. When the contacts 132 are in contact with and electrically connected to the electrodes 65 on the circuit board 64, the controller 1 is able to access the memory 66 on the circuit board 64. When the contacts 132 are not in contact with the electrodes 65 on the circuit board 64, the controller 1 cannot access the memory 66.

If the controller 1 cannot access the memory 66 (S20: NO), in S30 the controller 1 determines that an ink cartridge 30 is not mounted in the cartridge-attachment portion 110. In this case, the controller 1 notifies the user that an ink cartridge 30 is not mounted by displaying a message on a display panel (not shown) provided on a housing of the printer 10 and/or emitting a beep or other sound from a speaker (not shown).

However, when the controller 1 can access the circuit board 64 (S20: YES), in S40 the controller 1 determines whether the signal outputted from the optical sensor 113 to the controller 1 is high level or low level. When the projection 67 is positioned between the light-emitting part and light-receiving part of the optical sensor 113, the optical sensor 113 outputs a low level signal to the controller 1. When the projection 67 is not positioned between the light-emitting part and light-receiving part of the optical sensor 113, the optical sensor 113 outputs a high level signal to the controller 1.

When the signal outputted from the optical sensor 113 to the controller 1 is high level (S40: HIGH), in S50 the controller 1 determines that an abnormal ink cartridge 30 is attached to the cartridge-attachment portion 110. In this case, the controller 1 notifies the user that an abnormal ink cartridge 30 is mounted by displaying a message on the display panel (not shown) provided on the housing of the printer 10 and/or playing a beep or other sound from the speaker (not shown).

On the other hand, if the signal outputted by the optical sensor 113 is low level (S40: LOW), in S60 the controller 1 determines that a normal ink cartridge 30 is attached to the cartridge-attachment portion 110.

In the flowchart of FIG. 10, the controller 1 determines whether an ink cartridge 30 is mounted in the cartridge-attachment portion 110 based on whether the circuit board 64 is accessible, and determines whether the ink cartridge 30 mounted in the cartridge-attachment portion 110 is normal based on the level of the signal outputted from the optical sensor 113.

However, the controller 1 may be configured to determine whether an ink cartridge 30 is mounted in the cartridge-attachment portion 110 based on the level of the signal outputted from the optical sensor 113 and to determine whether the ink cartridge 30 mounted in the cartridge-attachment portion 110 is normal based on whether the circuit board 64 is accessible. Steps in this variation will be described next with reference to the flowchart in FIG. 11.

Referring to FIG. 11, the controller 1 first determines in S110 whether the cover 111 is in the closed position, as in the flowchart of FIG. 10. The controller 1 repeats the determination in S110 (S110: NO) until the cover 111 is determined to be in the closed position, i.e., until the signal outputted from the cover sensor 118 changes from high level to low level.

When the controller 1 determines in S110 that the cover 111 is in the closed position (S110: YES), in S120 the controller 1 determines whether the signal outputted from the optical sensor 113 to the controller 1 is high level or low level.

If the signal outputted by the optical sensor 113 is high level (S120: HIGH), in S130 the controller 1 determines that an ink cartridge 30 is not mounted in the cartridge-attachment portion 110. In this case, as in S30 of FIG. 10, the controller 1 notifies the user that an ink cartridge 30 is not mounted.

However, if the signal outputted by the optical sensor 113 is low level (S120: LOW), in S140 the controller 1 determines whether the circuit board 64 of the ink cartridge 30 is accessible.

If the controller 1 cannot access the circuit board 64 (S140: NO), in S150 the controller 1 determines that an abnormal ink cartridge 30 is mounted in the cartridge-attachment portion 110. In this case, as in S50 of FIG. 10, the controller 1 notifies the user that an abnormal ink cartridge 30 is mounted.

On the other hand, if the controller 1 can access the circuit board 64 (S140: YES), in S160 the controller 1 determines that a normal ink cartridge 30 is mounted in the cartridge-attachment portion 110.

<Operational and Technical Advantages of the Embodiment>

According to the described embodiment, the second region 61B constituting the first surface 61 of the substrate 63 is positioned lower than the first region 61A. That is, the memory 66 mounted on the second surface 262 at a region opposite the second region 61B is positioned lower than the electrodes 65 formed on the first region 61A. Accordingly, this arrangement reduces a potential for the second region 61B (memory 66 and battery 68) to contact the cartridge-attachment portion 110 as the ink cartridge 30 is being inserted into the cartridge-attachment portion 110.

Further, if the cartridge-attachment portion 110 contacts the top of the ink cartridge 30, such contact is less likely to impinge negative impact to the memory 66 and battery 68, since the memory 66 and battery 68 are disposed on the second surface 62 at the region lower than the first region 61A (opposite to the second region 61B).

In the present embodiment, the single flexible substrate 63 can provide a stepped structure along the recess 83 formed on the top surface 39A of the top wall 39.

Since the substrate 63 of the embodiment is a flexible substrate, the substrate 63 may deflect if contacted by the cartridge-attachment portion 110 while the ink cartridge 30 is being inserted into the cartridge-attachment portion 110. Hence, this configuration can reduce the potential for damage to the substrate 63 and components mounted on the substrate 63, such as the memory 66 and battery 68.

Since the lock surface 151 that can contact the shaft 145 of the cartridge-attachment portion 110 is higher than the electrodes 65 in the embodiment, the shaft 145 is also positioned higher than the electrodes 65. Accordingly, the electrodes 65 are unlikely to contact the shaft 145 while the ink cartridge 30 is being inserted into the cartridge-attachment portion 110.

Further, the electrodes 65 are elongated in the front-rear direction in the depicted embodiment. Therefore, even if the position of the ink cartridge 30 in the cartridge-attachment portion 110 in the front-rear direction varies in the state where the ink cartridge 30 is attached to the cartridge-attachment portion 110, this configuration can reduce a potential for the electrodes 65 losing contact with the contacts 132.

According to the structure of the embodiment, the second region 61B can be prevented from contacting the rear wall 136 and front wall 137 of the connector 130 in the cartridge-attachment portion 110 while the ink cartridge 30 is being inserted into the cartridge-attachment portion 110.

In the depicted embodiment, the cartridge-attachment portion 110 contacts the rubber sealing member 76 prior to contacting the circuit board 64 during the process of attaching the ink cartridge 30 to the cartridge-attachment portion 110. This contact reduces a speed at which the ink cartridge 30 is inserted and can soften the force of impact with the circuit board 64.

<First Modification>

In the depicted embodiment, the memory 66 and battery 68 are mounted on the second surface 62 of the substrate 63 at the region opposite the second region 61B of the first surface 61 (see FIG. 4). However, mounted positions of the memory 66 and battery 68 are not limited to the positions described in the embodiment.

Figure 12A:
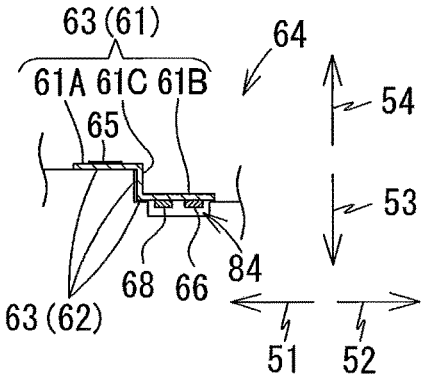
FIGS. 12A through 12G are partially-enlarged cross-sectional views illustrating various circuit boards of ink cartridges according to a first modification to the embodiment.

For example, in the embodiment described above, the battery 68 is mounted at a position separated farther than the memory 66 from the first region 61A in the front-rear direction (see FIG. 4). However, the battery 68 may be mounted at a position closer than the memory 66 to the first region 61A in the front-rear direction (see FIG. 12A). Alternatively, the battery 68 may be mounted in a position aligned with the memory 66 in the left-right direction.

Figure 12B:
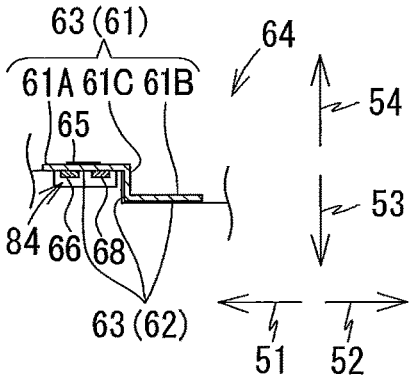
Figure 12C:
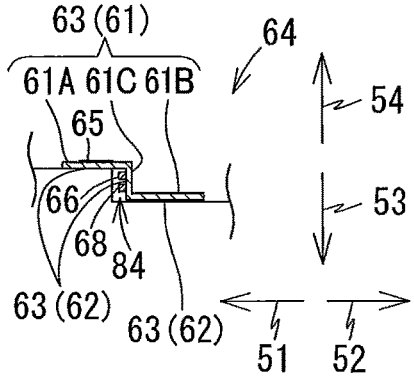
Figure 12D:
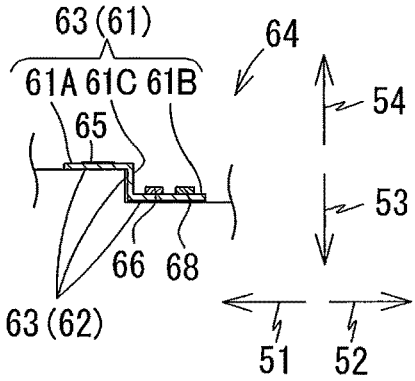
Figure 12E:
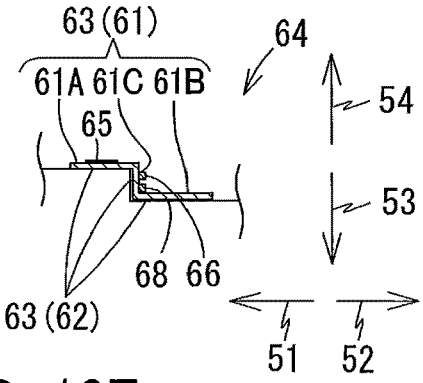

Still alternatively, for example, the memory 66 and battery 68 may be mounted on the second surface 62 of the substrate 63 at a region opposite the first region 61A of the first surface 61 (see FIG. 12B); or may be mounted on the second surface 62 of the substrate 63 at a region opposite the step 61C of the first surface 61 (see FIG. 12C). Still alternatively, the memory 66 and battery 68 may be mounted at the second region 61B on the first surface 61 (see FIG. 12D) or may be mounted on the step 61C of the first surface 61 (see FIG. 12E).

Figure 12F:
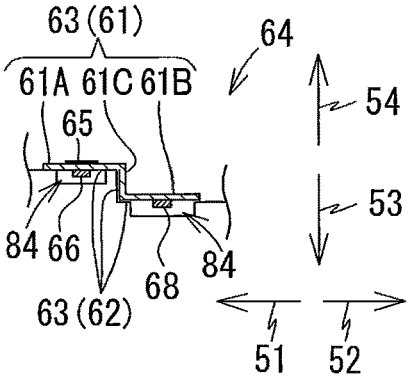
Figure 12G:
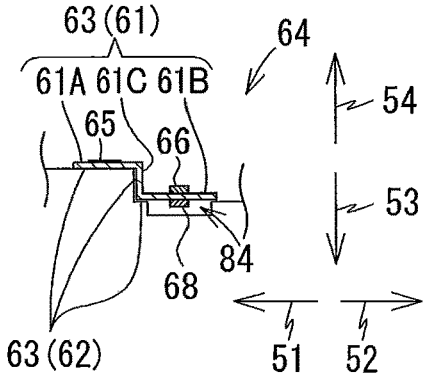

In the embodiment described above, the memory 66 and battery 68 are mounted on the second surface 62 of the substrate 63 at the region opposite the second region 61B of the first surface 61 (see FIG. 4). In other words, the memory 66 and battery 68 are mounted in the same area of the substrate 63. However, the memory 66 and battery 68 may be mounted in different areas of the substrate 63. For example, the memory 66 may be mounted on the second surface 62 at an area opposite the first region 61A, while the battery 68 is mounted on the second surface 62 at an area opposite the second region 61B (see FIG. 12F). Alternatively, the battery 68 may be mounted on the second surface 62 at an area opposite the second region 61B, while the memory 66 may be mounted on the second region 61B of the first surface 61 (see FIG. 12G).

<Second Modification>

Figure 13:
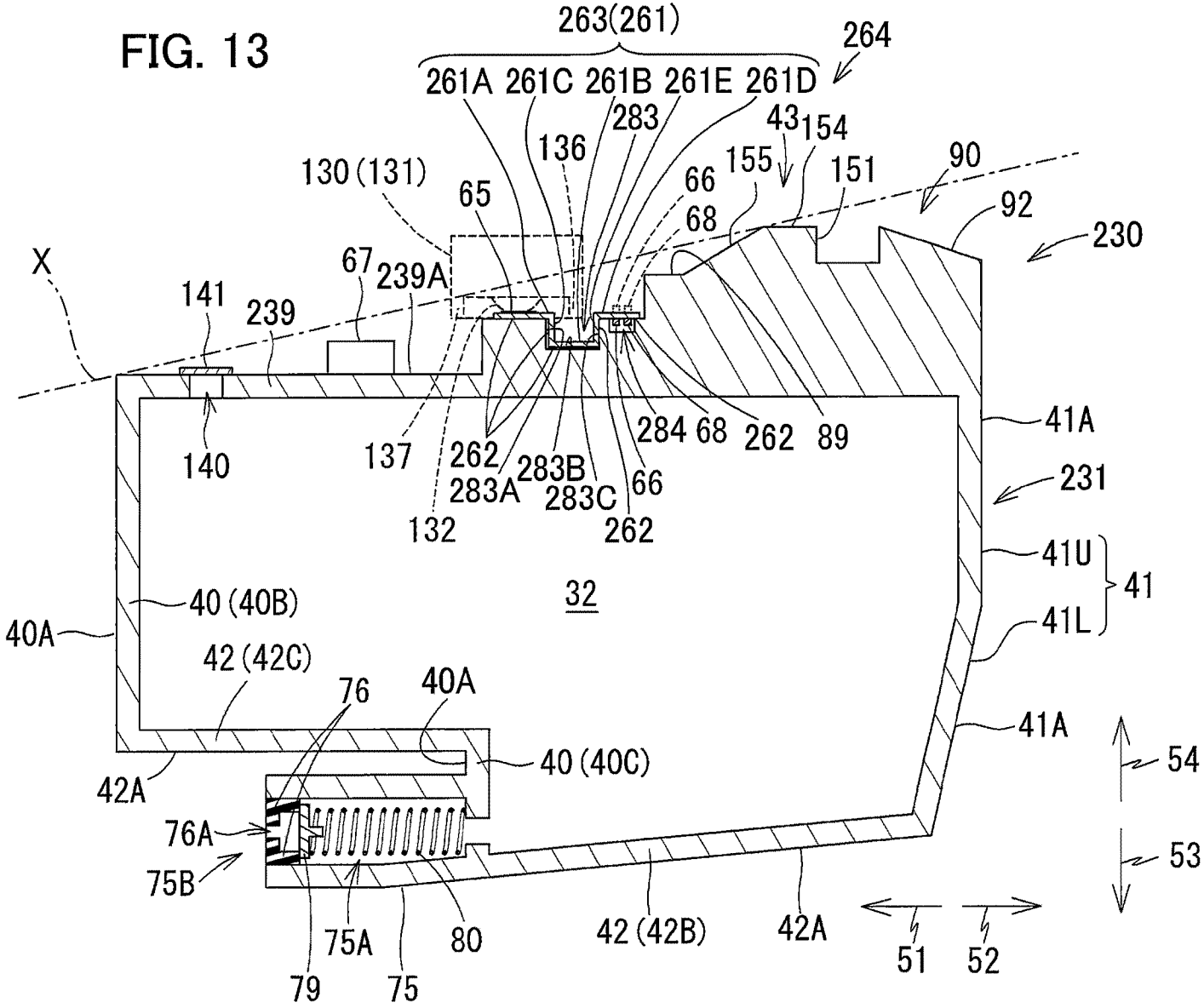
FIG. 13 is a vertical cross-sectional view of an ink cartridge according to a second modification to the embodiment.

The substrate 63 is not limited to the shape shown in FIG. 4. For example, FIG. 13 shows an ink cartridge 230 according to a second modification of the embodiment. The ink cartridge 230 includes a housing 231 and a circuit board 264 fixed to a top wall 239 of the housing 231. The circuit board 264 includes a substrate 263 having a first surface 261 and a second surface 262 opposite the first surface 261. The first surface 261 includes: a first region 261A corresponding to the first region 61A, a second region 261B corresponding to the second region 61B, a step 261C corresponding to the step 61C, a third region 261D, and a step 261E.

The third region 261D is a portion of the first surface 261 that is positioned rearward of the recess 83 in the front-rear direction. The third region 261D is aligned with the first region 261A in the front-rear direction, as illustrated in FIG. 13. In this modification, the third region 261D is at the same height as the first region 261A in the vertical direction. The third region 261D is arranged higher than the second region 261B. Note that the third region 261D may be arranged higher than the first region 261A, provided that the third region 261D is positioned rearward of the second region 261B. Still alternatively, the third region 261D may be arranged lower than the first region 261A, provided that the third region 261D is positioned higher and rearward relative to the second region 261B.

The step 261E is a portion of the first surface 261 between the second region 261B and the third region 261D. The step 261E extends along a side surface 283C defining a recess 283 corresponding to the recess 83 of the embodiment. A top edge of the step 261E is continuous with a front edge of the third region 261D, and a bottom edge of the step 261E is continuous with a rear edge of the second region 261B. Hence, the third region 261D is connected to the rear edge of the second region 261B through the step 261E.

Note that, in the second modification, the recess 283 is defined by: a side surface 283A corresponding to the side surface 83A; a bottom surface 283B constituting a bottom of the recess 283; and the side surface 283C. These surfaces 283A, 283B and 283C belong to a top surface 239A of the top wall 239 of the housing 231. The step 261C extends along the side surface 283A; the second region 261B extends along the bottom surface 283B; and the step 261E extends along the side surface 283C.

The memory 66 and battery 68 are mounted on the second surface 262 of the substrate 263 at a region opposite the third region 261D of the first surface 261. A depression 284 corresponding to the depression 84 of the embodiment is formed in the top wall 239 to accommodate the memory 66 and battery 68 therein.

Note that the memory 66 and battery 68 can be mounted at various positions, such as those described in the first modification (for example, on the second surface 262 of the substrate 263 at regions opposite the first region 261A, the second region 261B, the step 261C, or the step 261E of the first surface 261; and on the second region 261B, the step 261C, the third region 261D, or the step 261E constituting the first surface 61 of the substrate 63). The memory 66 and battery 68 mounted on the third region 261D of the first surface 261 are depicted with dashed lines in FIG. 13.

When the ink cartridge 30 having the structure shown in FIG. 13 is in the attached state in the cartridge holder 101, the second region 261B is vertically aligned with the rear wall 136 of the connector 130 and is positioned lower than the rear wall 136. Further, the third region 261D is positioned farther rearward than the rear wall 136 when the ink cartridge 30 is in the attached state.

The structure according to the second modification can reduce the possibility of the second region 261B contacting the cartridge-attachment portion 110 as the ink cartridge 30 is being inserted into the cartridge-attachment portion 110.

Further, in the second modification, the memory 66 is provided on the second surface 62 at a position opposite the third region 261D that is separated from the second region 261B, which in turn is separated from the first region 261A. Thus, the memory 66 is arranged at a position separated away from the electrodes 65. Accordingly, the portion of the first surface 61 on the side opposite the memory 66 (i.e., the third region 261D) is unlikely to collide with the contacts 132 on the cartridge-attachment portion 110 that connect with the electrodes 65.

<Third Modification>

In the depicted embodiment, the second region 61B of the first surface 61 on the substrate 63 is positioned rearward of the first region 61A. However, the second region 61B may instead be positioned forward of the first region 61A.

Figure 14:
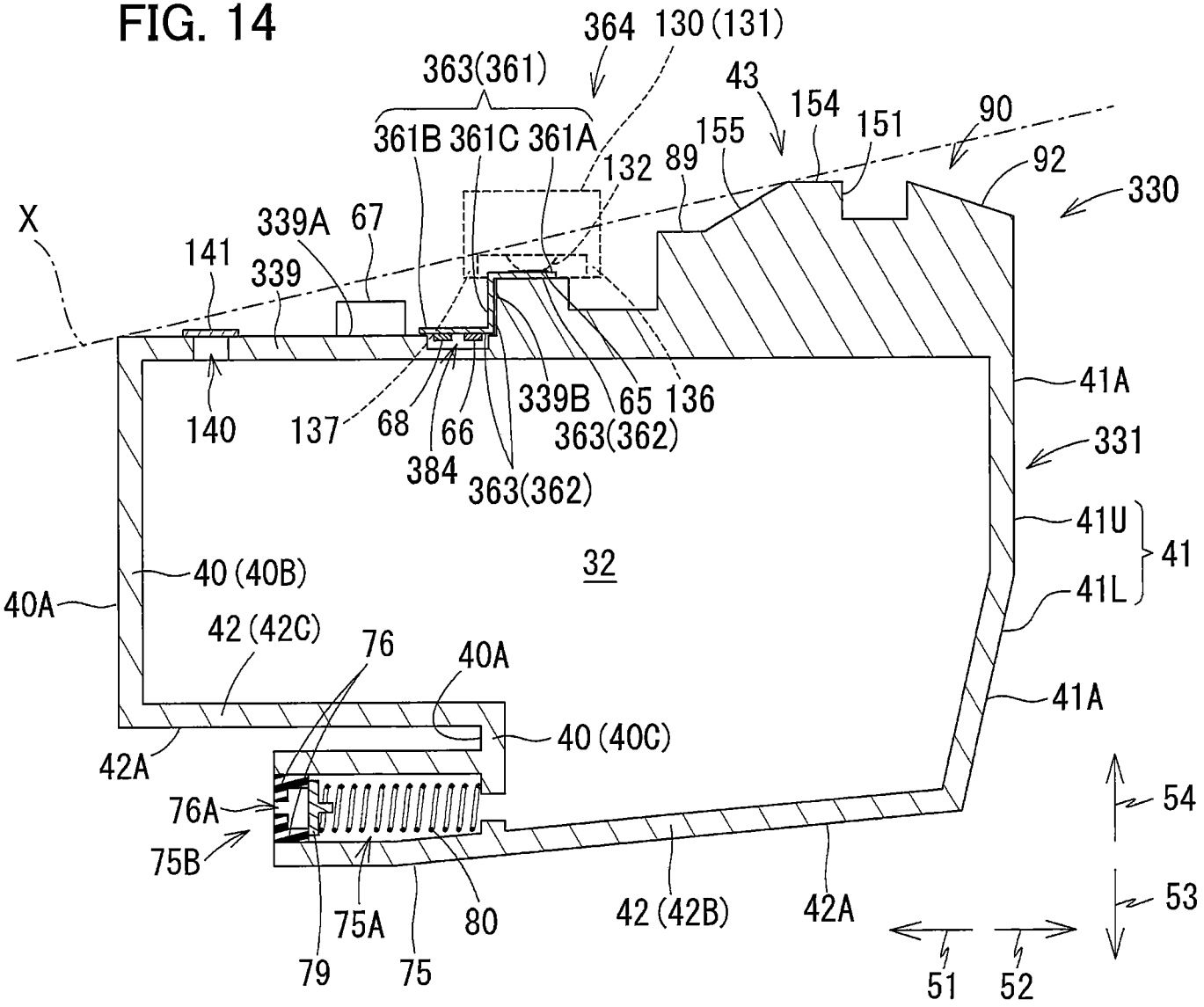
FIG. 14 is a vertical cross-sectional view of an ink cartridge according to a third modification to the embodiment.

Specifically, FIG. 14 depicts an ink cartridge 330 provided with a circuit board 364 according to a third modification of the embodiment. The circuit board 364 includes a housing 331 and a substrate 363 fixed to a top wall 339 of the housing 331. The substrate 363 has a first surface 361 and a second surface 362 opposite the first surface 361. The first surface 361 includes a first region 361A corresponding to the first region 61A, a second region 361B and a step 361C.

In the third modification, the second region 361B of the first surface 361 is positioned forward of and lower than the first region 361A. The second region 361B is also positioned rearward of the projection 67.

The step 361C extends along a step surface 339B positioned between the positioning surface 89 and projection 67. The step surface 339B is a vertical surface constituting a portion of a top surface 339A of the top wall 339 of the housing 331. A top edge of the step 361C is continuous with a front edge of the first region 361A, while a bottom edge of the step 361C is continuous with a rear edge of the second region 361B.

In FIG. 14, the memory 66 and battery 68 are mounted on the second surface 362 of the substrate 363 at a region opposite the second region 361B of the first surface 361. The memory 66 and battery 68 may also be mounted in various other positions, as described in the first modification. The top wall 339 is formed with a depression 384 corresponding to the depression 84 of the embodiment. Hence, the memory 66 and battery 68 mounted on the second surface 362 of the substrate 363 are accommodated in the depression 384.

When the ink cartridge 330 having the structure shown in FIG. 14 is mounted in the cartridge holder 101, the second region 361B is vertically aligned with the front wall 137 of the connector 130 and is positioned below the front wall 137.

Further, as in the second modification of the embodiment, the first surface 361 of the substrate 363 in the third modification may also include portion corresponding to the third region 261D and step 261E, in addition to the first region 361A, second region 361B, and step 361C.

Figure 15:
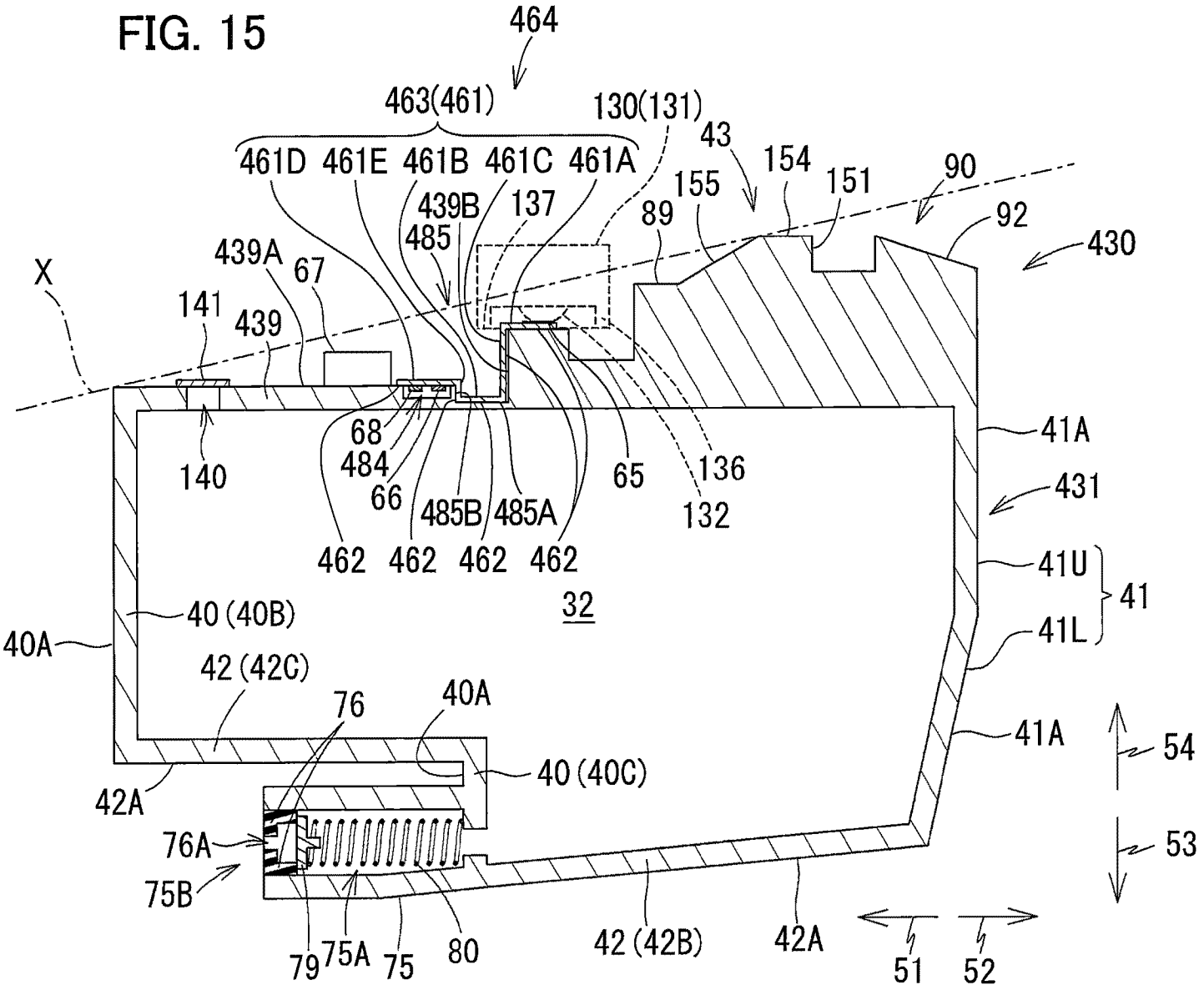
FIG. 15 is a vertical cross-sectional view of an ink cartridge according to a variation of the third modification.

Specifically, FIG. 15 depicts an ink cartridge 430 according to such a modification to the third modification.

The ink cartridge 430 includes a housing 431 and a circuit board 464 fixed to a top wall 439 of the housing 431.

In the ink cartridge 430 shown in FIG. 15, a recess 485 is formed in the top wall 439 at a position rearward of the projection 67 and forward of a step surface 439B corresponding to the step surface 339B. The recess 485 is defined by: the step surface 439B; a bottom surface 485A; and a side surface 485B. These surfaces 439B, 485A and 485B constitute part of a top surface 449A of the top wall 439.

The circuit board 464 of this modification includes a substrate 463 having a first surface 461 and a second surface 462.

The first surface 461 includes: a first region 461A corresponding to the first region 361A; a second region 461B corresponding to the second region 361B; a step 461C corresponding to the step 361C; a third region 461D corresponding to the third region 261D; and a step 461E corresponding to the step 261E.

The second region 461B extends along the bottom surface 485A defining the recess 485.

The third region 461D is a portion of the first surface 461 that is positioned forward of the recess 485 in the front-rear direction. The third region 461D is also positioned higher than the second region 461B and lower than the first region 461A. Alternatively, the third region 461D may be at the same vertical position as the first region 461A.

The step 461E is a portion of the first surface 461 positioned between the second region 461B and third region 461D. The step 461E extends along the side surface 485B defining the recess 485. A top edge of the step 461E is continuous with a rear edge of the third region 461D, while a bottom edge of the step 461E is continuous with a front edge of the second region 461B. Hence, the third region 461D is connected to the front edge of the second region 461B via the step 461E.

In FIG. 15, the memory 66 and battery 68 are mounted on the second surface 462 of the substrate 463 at a region opposite the third region 461D of the first surface 461. A depression 484 corresponding to the depression 284 is formed in a top wall 439 to accommodate the memory 66 and battery 68 therein. Incidentally, the memory 66 and battery 68 may be mounted in various other positions, as described in the first modification.

When the ink cartridge 430 having the structure shown in FIG. 15 is mounted in the cartridge holder 101, the second region 461B is vertically aligned with the front wall 137 of the connector 130 and positioned below the front wall 137. Also, the third region 461D is positioned forward of the front wall 137 when the ink cartridge 30 is in the attached state.

The structure shown in FIG. 15 can reduce a potential for the second region 461B contacting the cartridge-attachment portion 110 as the ink cartridge 430 is inserted into the cartridge-attachment portion 110.

<Fourth Modification>

In the embodiment described above, the substrate 63 is a flexible substrate. However, at least part of the substrate 63 may be configured of a rigid substrate formed of glass epoxy or the like.

Figure 16:
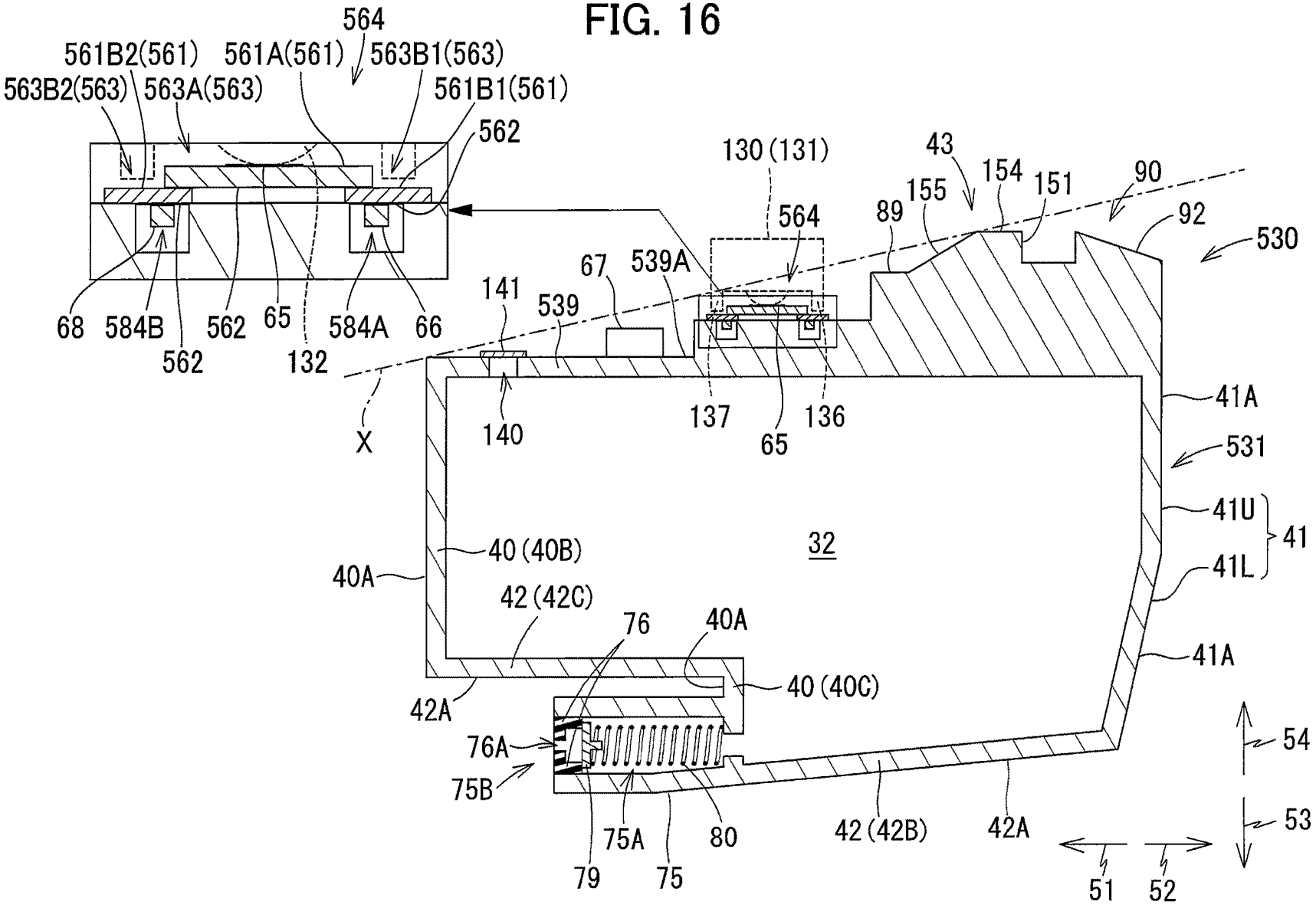
FIG. 16 is a vertical cross-sectional view of an ink cartridge according to a fourth modification to the embodiment.

As an example, FIG. 16 depicts an ink cartridge 530 according to a fourth modification of the embodiment. The ink cartridge 530 includes a housing 531 and a circuit board 564 fixed to a top wall 539 of the housing 531. The circuit board 564 includes a substrate 563 configured of: a first substrate 563A that is a rigid substrate; and second substrates 563B1 and 563B2 that are also both rigid substrates. In other words, the entire substrate 563 may be configured of just rigid substrates.

Referring to FIG. 16, a front part on an upper surface 561B1 of the second substrate 563B1 is bonded to a rear part on a lower surface of the first substrate 563A so as to support and be continuous with the rear part of the lower surface of the first substrate 563A. Similarly, a rear part on an upper surface 561B2 of the second substrate 563B2 is bonded to a front part on the lower surface of the first substrate 563A to support and be continuous with the same. Thus, the second substrates 563B1 and 563B2 support the first substrate 563A from below and, hence, are beneath the first substrate 563A.

In the substrate 563, an upper surface 561A of the first substrate 563A, a rear part on the upper surface 561B1 of the second substrate 563B1 and a front part on the upper surface 561B2 of the second substrate 563B2 constitute a first surface 561 of the substrate 563. Further, a lower surface of the second substrate 563B1, a lower surface of the second substrate 563B2 and a center part on the lower surface of the first substrate 563A constitute a second surface 562 of the substrate 563.

In the fourth modification, the first surface 561 on the first substrate 563A (i.e., the upper surface 561A of the first substrate 563A) constitutes a first region 561A corresponding to the first region 61A of the embodiment. In other words, the electrodes 65 are formed on the first surface 561 of the first substrate 563A. The first surface 561 belonging to the second substrates 563B1 and 563B2 (i.e., the upper surface 561B1 of the second substrate 563B1 and the upper surface 561B2 of the second substrate 563B2) constitutes a second region 561B corresponding to the second region 61B of the embodiment.

In the configuration of FIG. 16, the memory 66 is mounted on the lower surface of the second substrate 563B1 (i.e., on the second surface 562), and the battery 68 is mounted on the lower surface of the second substrate 563B2 (i.e., on the second surface 562). However, the mounting positions of the memory 66 and battery 68 may be identical to the depicted embodiment or the modifications described above and are not limited to the positions shown in FIG. 16. The memory 66 is electrically connected to the electrodes 65 formed on the first substrate 563A. The memory 66 is also electrically connected to the battery 68 via the first substrate 563A. Here, depressions 584A and 584B are formed in a top surface 539A of the top wall 539 at areas corresponding to the regions in which the memory 66 and battery 68 are mounted. The memory 66 is accommodated in the depression 584A, and the battery 68 is accommodated in the depression 584B.

When the ink cartridge 530 having the structure shown in FIG. 16 is mounted in the cartridge holder 101, the first surface 561 of the second substrate 563B1 (upper surface 561B1) is vertically aligned with the rear wall 136 of the connector 130 and is positioned below the rear wall 136. Further, the first surface 561 of the second substrate 63B2 (upper surface 561B2) is vertically aligned with the front wall 137 of the connector 130 and is positioned below the front wall 137 when the ink cartridge 530 is in the attached state.

Figure 17:
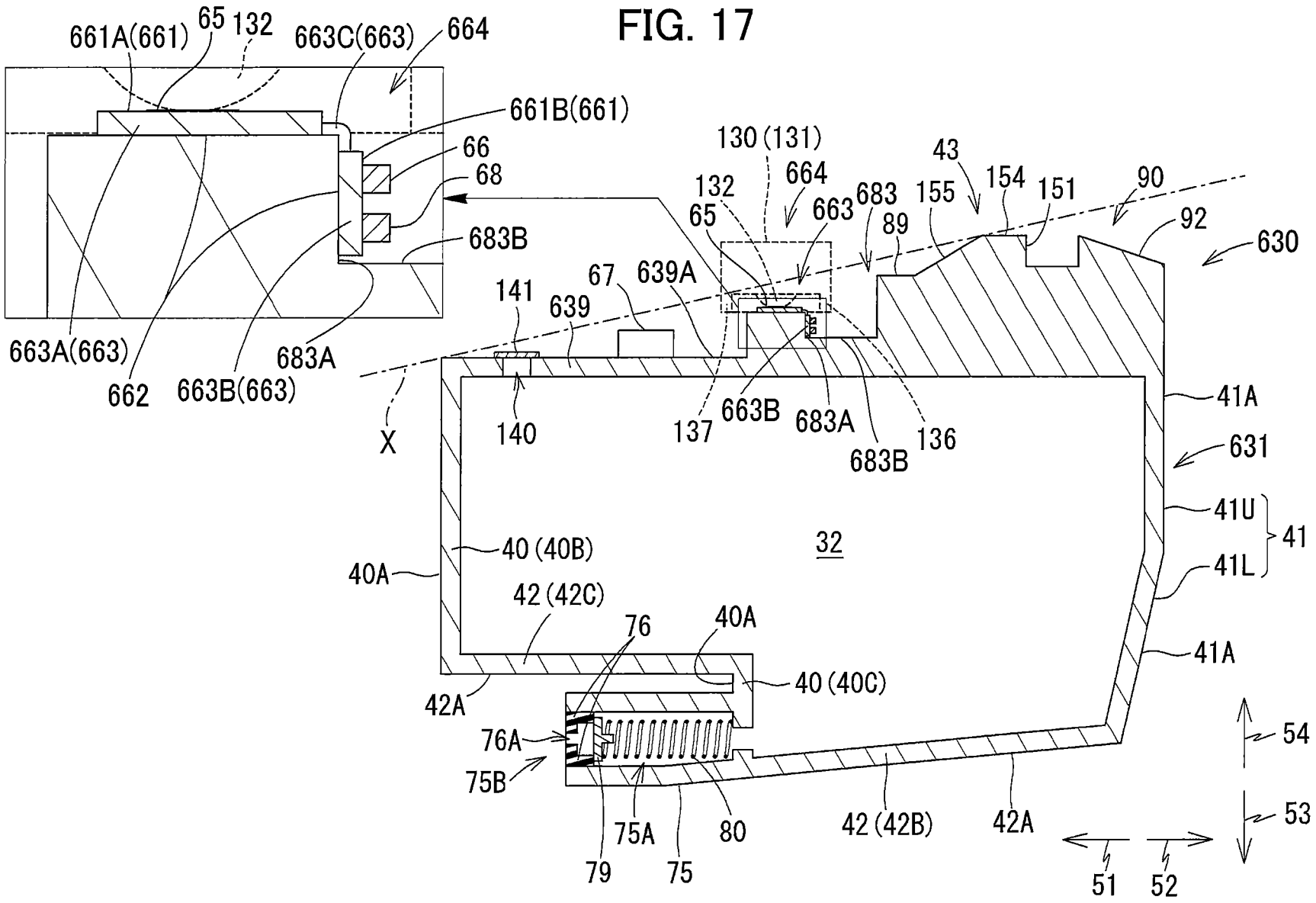
FIG. 17 is a vertical cross-sectional view of an ink cartridge according to a variation of the fourth modification.

FIG. 17 depicts an alternative structure to the fourth modification. An ink cartridge 630 according to this variation includes a housing 631 and a circuit board 664 fixed to a top wall 639 of the housing 631. The circuit board 664 includes a substrate 663 configured of a rigid first substrate 663A, a rigid second substrate 663B, and a flexible third substrate 663C. In other words, just part of the substrate 663 is configured of rigid substrates.

In FIG. 17, the first substrate 663A is positioned forward of a recess 683 formed in a top surface 639A of the top wall 639. The second substrate 663B is bonded to a side surface 683A defining the recess 683. The electrodes 65 are formed on an upper surface 661A of the first substrate 663A. The memory 66 and battery 68 are mounted on an outer surface 661B of the second substrate 663B. In this variation, the upper surface 661A of the substrate 663A and the outer surface 661B of the second substrate 663B constitute a first surface 661 of the substrate 663. Here, the mounted positions of the memory 66 and battery 68 may be identical to the depicted embodiment or modifications thereof and are not limited to the positions shown in FIG. 17. One end of the third substrate 663C is bonded to the first substrate 663A, and the other end is bonded to the second substrate 663B. Through this configuration, the memory 66 is electrically connected to the electrodes 65 via the third substrate 663C.

When the ink cartridge 630 having the structure shown in FIG. 17 is mounted in the cartridge holder 101, the rear wall 136 of the connector 130 vertically opposes a bottom surface 683B defining the bottom of the recess 683.

In the arrangement of this variation, the second region 661B can be easily formed by the second substrate 663B.

Figure 18:
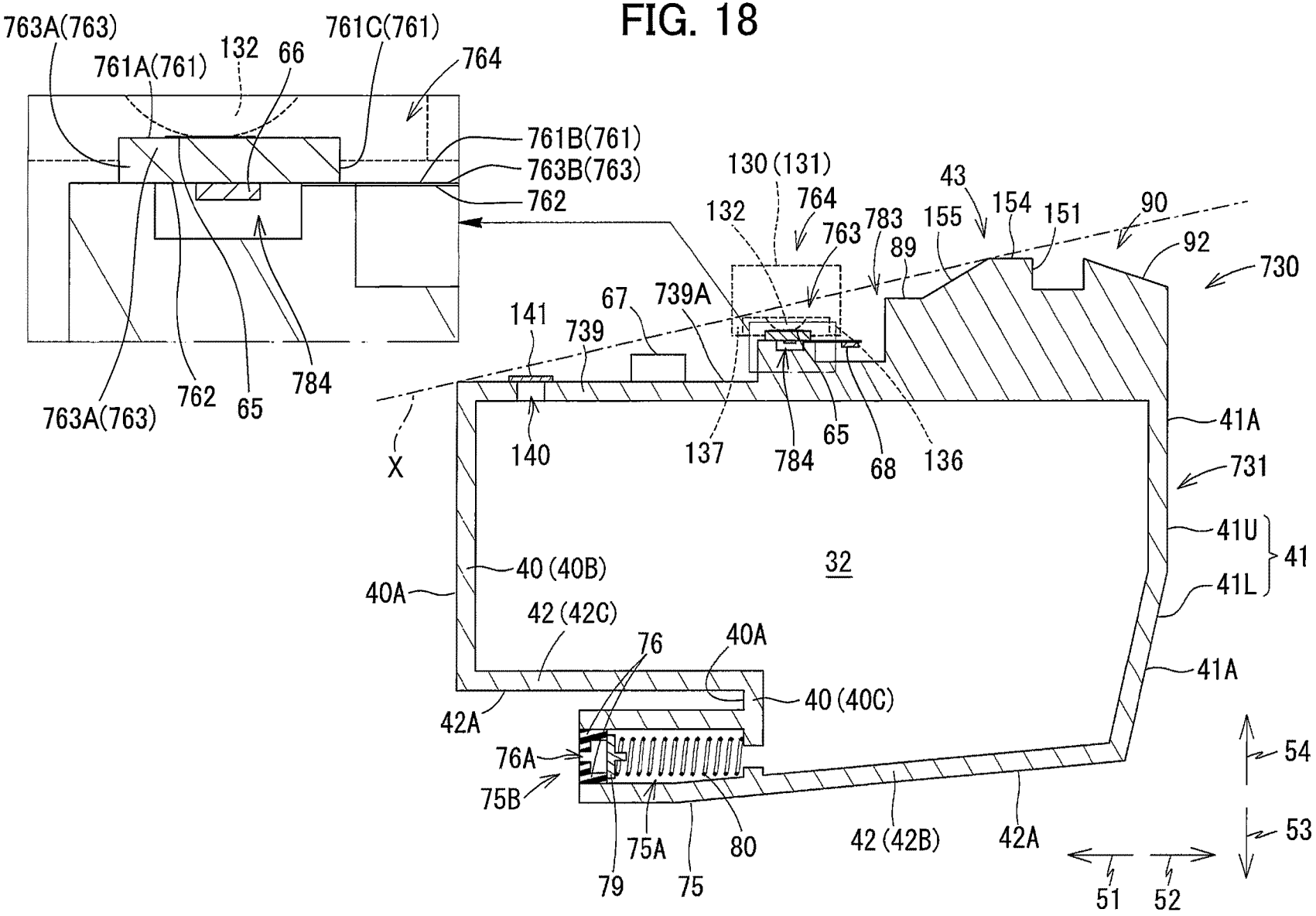
FIG. 18 is a vertical cross-sectional view of an ink cartridge according to another variation of the fourth modification.

FIG. 18 depicts still another variation of the fourth modification.

An ink cartridge 730 according to this variation includes a housing 731 and a circuit board 764 fixed to a top wall 739 of the housing 731. The circuit board 764 includes a substrate 763 configured of a rigid first substrate 763A, and a flexible second substrate 763B. In other words, just part of the substrate 763 is configured of a rigid substrate.

In FIG. 18, the first substrate 763A is positioned forward of a recess 783 formed in a top surface 739A of the top wall 739. The first substrate 763A is a rigid substrate having a thickness greater than a thickness of the substrate 63 of the embodiment. The electrodes 65 are formed on an upper surface of the first substrate 763A. The second substrate 763B is a flexible substrate and is fixed to a lower surface of the first substrate 763A. In this variation, a side surface 761C of the first substrate 763A serves as the step 61C of the embodiment, and hence, the side surface 761C and an upper surface of the second substrate 763B define a recess that is recessed downward relative to the upper surface 761A of the first substrate 763A. Thus, the upper surface of the substrate 763A, side surface 761C of the first substrate 763A, and the upper surface of the second substrate 763B constitute a first surface 761 of the substrate 763. In the first surface 761, the upper surface of the first substrate 763A serves as a first region 761A, and the upper surface of the second substrate 763B serves as a second region 761B lower than the first region 761A. The lower surface of the first substrate 763A and a lower surface of the second substrate 763B constitute a second surface 762 of the substrate 763.

The memory 66 is mounted on the lower surface of the first substrate 763A (on the second surface 762). The memory 66 is accommodated in a depression 784 formed in the top surface 739A of the top wall 739. The battery 68 is mounted on the lower surface of the second substrate 763B (on the second surface 762). Here, the mounted positions of the memory 66 and battery 68 may not limited to the positions shown in FIG. 18, but may be arranged as depicted in the embodiment and in the first variation.

When the ink cartridge 730 having the structure shown in FIG. 18 is in the attached state in the cartridge holder 101, the second region 761B is vertically aligned with the rear wall 136 of the connector 130 and is positioned lower than the rear wall 136. Hence, the structure according to this variation of the fourth modification can reduce a likelihood that the second region 761B may contact the cartridge-attachment portion 110 (the rear wall 136) as the ink cartridge 730 is being inserted into the cartridge-attachment portion 110.

<Fifth Modification>

In the embodiment described above, the second region 61B of the substrate 63 is lower than the rear wall 136 and front wall 137 when the ink cartridge 30 is being inserted into the cartridge holder 101 and when the ink cartridge 30 is in the attached state in the cartridge holder 101. Hence, the second region 61B of the substrate 63 does not contact the rear wall 136 and front wall 137. However, the substrate 63 may be configured so that at least a portion of the second region 61B contacts the rear wall 136 and front wall 137 and bends during the insertion process and in the attached state.

Figure 19A:
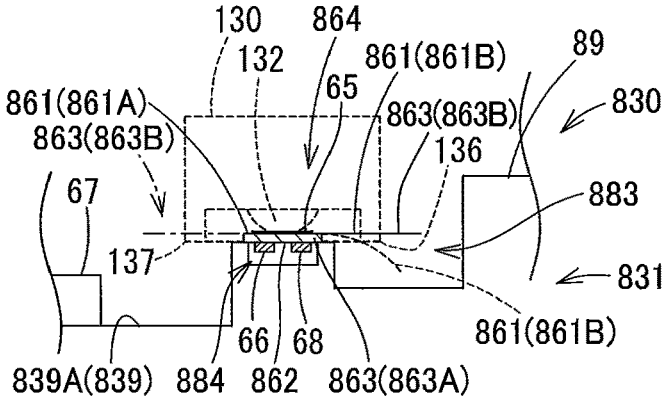
FIGS. 19A through 19D are partially-enlarged vertical cross-sectional views of ink cartridges according to a fifth modification to the embodiment.

For example, FIG. 19A depicts a circuit board 864 including a substrate 863 configured of a rigid first substrate 863A and a flexible second substrate 863B. The first substrate 863A is supported by a top surface 839A of a top wall 839 of a housing 831 at a position frontward of a recess 883 (corresponding to the recess 83) and rearward of the projection 67. The second substrate 863B extends rearward from the first substrate 863A. A distal edge (rear edge) of the second substrate 863B does not contact any part of the housing 831 of an ink cartridge 830. That is, the rear edge of the second substrate 863B is separated (spaced apart) from the top surface 839A of the top wall 839. The second substrate 863B is positioned above the recess 883. When the ink cartridge 830 is being inserted into the cartridge holder 101, the second substrate 863B is contacted from above by the rear wall 136 of the connector 130 and pushed downward. Through this pressure, the second substrate 863B deflects downward, as indicated by a dashed line in FIG. 19A.

In the structure shown in FIG. 19A, an upper surface of the first substrate 863A and an upper surface of the second substrate 863B constitute a first surface 861 of the substrate 863. Specifically, the upper surface of the rigid first substrate 863A serves as a first region 861A on the first surface 861, whereas and the upper surface of the flexible second substrate 863B serves as a second region 861B on the first surface 861. That is, an entirety of the second region 861B is flexible in the structure shown in FIG. 19A. The second region 861B is aligned with the first region 861A in the front-rear direction in the upright posture. Lower surfaces of the first substrate 863A and second substrate 863B constitute a second surface 862 of the substrate 863.

Figure 19B:
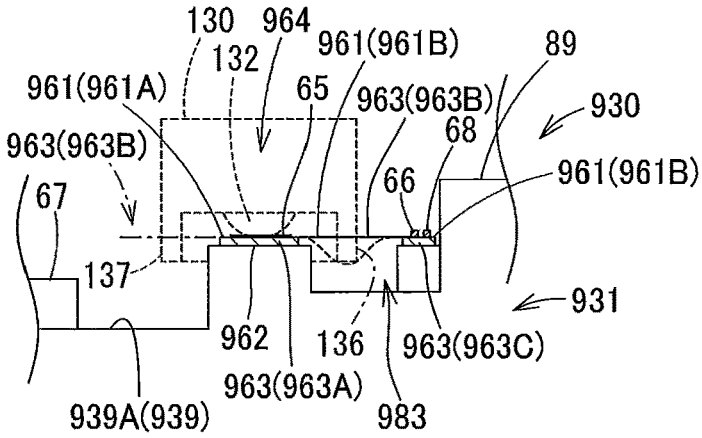

Alternatively, FIG. 19B depicts a circuit board 964 including a substrate 963 configured of a rigid first substrate 963A, a flexible second substrate 963B, and a rigid third substrate 963C. The first substrate 963A is supported by a top surface 939A of a top wall 939 of a housing 931 at a position frontward of a recess 983 and rearward of the projection 67. The third substrate 963C is supported by the top surface 939A (top wall 939) at a position rearward of the recess 983. The second substrate 963B is disposed between the first substrate 963A and third substrate 963C and is positioned above the recess 983. A front edge of the second substrate 963B is connected to the first substrate 963A, while a rear edge of the second substrate 963B is connected to the third substrate 963C. When an ink cartridge 930 of this variation is being inserted into the cartridge holder 101, the second substrate 963B is contacted from above by the rear wall 136 of the connector 130 and is pushed downward. Through this action, the second substrate 963B deflects downward, as indicated by a dashed line in FIG. 19B. The structure in FIG. 19B differs from that in FIG. 19A in that the rear edge of the second substrate 963B is in contact with the third substrate 963C, but is similar to FIG. 19A in that a portion of the second substrate 963B vertically confronting the rear wall 136 is bent downward.

In the structure shown in FIG. 19B, an upper surface of the first substrate 963A, an upper surface of the second substrate 963B, and an upper surface of the third substrate 963C constitute a first surface 961 of the substrate 963. Specifically, in the first surface 961, the upper surface of the first substrate 963A constitutes a first region 961A, and the upper surface of the second substrate 963B and the upper surface of the third substrate 963C constitute a second region 961B. The second region 961B is aligned with the first region 961A in the front-rear direction in the upright posture. Hence, only part of the second region 961B (the upper surface of the second substrate 963B) is flexible in the structure shown in FIG. 19B. That is, the upper surface of the second substrate 963B serves as a deformable portion of the second region 961B. Lower surfaces of the first substrate 963A, second substrate 963B and third substrate 963C constitute a second surface 962 of the substrate 963.

In the structures shown in FIGS. 19A and 19B, each second substrate 863B, 963B extends rearward from the corresponding first substrate 863A, 963A. However, the second substrate 863B, 963B may extend forward from the first substrate 863A, 963A, as indicated by one-dot chain lines in FIGS. 19A and 19B. Hence, the second substrate 863B, 963B may be positioned forward of the first substrate 863A, 963A. When the second substrate 963B extends forward from the first substrate 963A in FIG. 19B, the third substrate 963C is disposed forward of the second substrate 963B and is connected to the same. With the structures of FIGS. 19A and 19B, the second substrate 863B, 963B may be deflected downward when contacted by the front wall 137 of the connector 130 during the insertion of the ink cartridge 830, 930 into the cartridge-attachment section 110. Hence, there is a smaller potential for damage to the second substrate 863B, 963B.

Figure 19C:
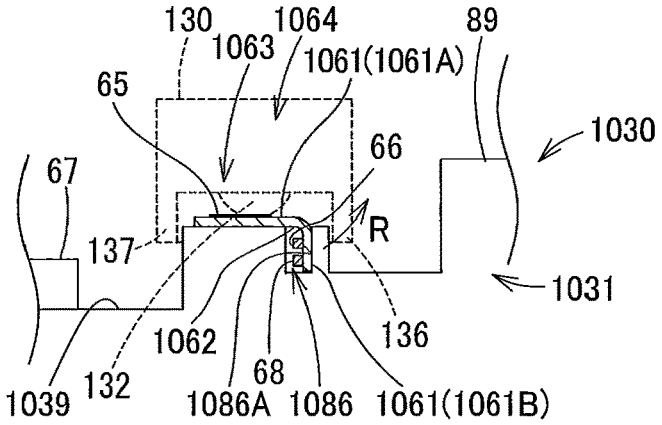

Still alternatively, the substrate 63 of the embodiment may be arranged in a bent state. For example, FIG. 19C depicts a circuit board 1064 configured of a flexible substrate 1063. A rear portion of the flexible substrate 1063 is bent downward with its bent portion inserted into a recess 1086 formed in a top wall 1039. A force for resiliently restoring the substrate 1063 from its bent state to its straight state in a direction R is applied to the rear portion of the substrate 1063. However, this resilient restoration is restricted by a side surface 1086A defining the recess 1086. According to the structure shown in FIG. 19C, an apparent front-rear length of the substrate 1063 can be reduced.

Here, an upper surface of the substrate 1063 constitutes a first surface 1061, while a lower surface of the substrate 1063 constitutes a second surface 1062. In the first surface 1061, a front portion other than the bent portion on the first surface 1061 (upper surface) of the substrate 1063 serves as a first region 1061A in this variation. The rear portion on the upper surface of the substrate 1063 (i.e., the bent portion accommodated in the recess 1086) serves as a second region 1061B on the first surface 1061. The second region 1061B is aligned with the first region 1061A in the frontward direction 51 in the upright posture.

In the structure shown in FIG. 19A, the electrodes 65 are formed on the first region 861A of the first surface 861 (i.e., the upper surface of the first substrate 863A), and the memory 66 and battery 68 are mounted on the second surface 862 at a region opposite the first region 861A (i.e., the lower surface of the first substrate 863A). The memory 66 and battery 68 are accommodated in a depression 884 formed in the top wall 839. In the structure shown in FIG. 19B, the electrodes 65 are formed on the first region 961A of the first surface 961 (i.e., the upper surface of the first substrate 963A), and the memory 66 and battery 68 are mounted on the second region 961B of the first surface 961 (i.e., the upper surface of the third substrate 963C). That is, the battery 68 and memory 66 are mounted at positions rearward of the deformable portion of the second region 961B (the upper surface of the second substrate 963B). Specifically, on the second region 961B, the battery 68 is mounted at a position farther away from the first region 961A than the memory 66 is from the first region 961A in the front-rear direction. In the structure shown in FIG. 19C, the electrodes 65 are formed on the first region 1061A of the first surface 1061 (i.e., the front portion on the upper surface of the substrate 1063), and the memory 66 and battery 68 are mounted on the second surface 1062 (i.e., the lower surface of the substrate 1063 at a region accommodated in the recess 1086). Note that the memory 66 and battery 68 may be mounted at positions other than those shown in FIGS. 19A to 19C.

Figure 19D:
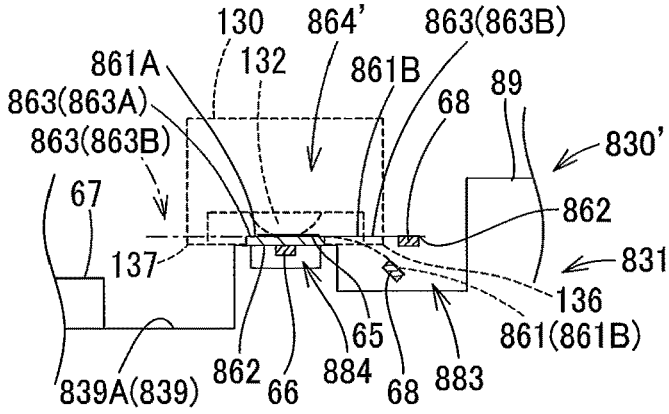

For example, the memory 66 and battery 68 may be arranged as depicted in FIG. 19D. An ink cartridge 830' of this variation includes a circuit board 864' including the substrate 863 of FIG. 19A. In this structure of FIG. 19D, the memory 66 is disposed on the second surface 862 at the region opposite the first region 861A (i.e., the lower surface of the rigid first substrate 863A), whereas the battery 68 is disposed on the second surface 862 at a region opposite the second region 861B (i.e., the lower surface of the flexible second substrate 863B). The battery 68 is mounted on the second surface 862 at a position farther away from the first region 861A than the memory 66 is from the first region 861A in the frontward direction 51.

Each of the substrates 863, 963 and 1063 has flexibility, at least partially. Hence, the substrates 863, 963 and 1063 of the fifth modification can easily be formed in a shape having low potential for contacting the cartridge-attachment portion 110, by bending the portion having flexibility, for example, as in the structure shown in FIG. 19C.

Further, when the ink cartridge 830, 930 according to the fifth modification is being inserted into the cartridge-attachment portion 110, the flexible portion of the second region 861B, 961B can be deflected when contacted by the cartridge-attachment portion 110, thereby reducing the potential for damage to this deformable portion.

Further, if the ink cartridge 830, 830', 930 according to the fifth modification is inserted farther than expected into the cartridge-attachment portion 110 during the insertion process, components of the cartridge-attachment portion 110 may come into contact with the second region 861B, 961B of the substrate 863, 963. However, the structure of the fifth modification can reduce a potential for damage to the second region 861B, 961B, since the second region 861B, 961B can deform, at least partially, when contacted by the cartridge-attachment portion 110.

Still further, in the structures of FIGS. 19A and 19D, since the rear edge of the second substrate 863B is not in contact with the housing 831, the second substrate 863B can readily deform when contacted by the cartridge-attachment portion 110. Through this deformation, impacts to the second substrate 863B when contacted by the cartridge-attachment portion 110 can be mitigated.

If the second region 861B, 961B contacts the rear wall 136 or front wall 137 in the cartridge-attachment portion 110 while the ink cartridge 830, 830', 930 according to the fifth modification is being inserted into the cartridge-attachment portion 110, the portion of the second region 861B, 961B that contacts the rear wall 136 or front wall 137 can deform, thereby reducing a potential for damage to this deformable portion.

<Other Variations>

In the embodiment and the modifications described above, communication between the passage 75A and the outside of the cylinder 75 is switched on and off with the valve 79. However, the opening 75B may be sealed with a seal rather than the valve 79. Specifically, the seal is affixed to the front surface of the cylinder 75 before the ink cartridge 30 is inserted into the cartridge-attachment portion 110, thereby sealing off the through-hole 76A from the outside. Hence, ink in the storage chamber 32 does not flow through the passage 75A and out of the ink cartridge 30 through the through-hole 76A. When the ink cartridge 30 is inserted into the cartridge-attachment portion 110, the tube 102 punctures the seal, breaking the hermetic seal.

In the embodiment described above, the ink cartridge 30 is pivoted inside the cartridge holder 101 while being inserted therein. However, the ink cartridge 30 need not be pivoted or tilted inside the cartridge holder 101 during the insertion process. For example, if the rear wall 136 is omitted from the connector 130 of the cartridge-attachment portion 110, the ink cartridge 30 can be inserted into the cartridge holder 101 in the front-rear direction without being pivoted. The rear wall 136 must be omitted from the connector 130 in this configuration, because the first region 61A of the substrate 63 could contact the rear wall 136 of the connector 130 during the insertion process if the ink cartridge 30 were inserted into the cartridge holder 101 in the front-rear direction with no pivotal movement.

In the embodiment described above, the ink cartridge 30 is fixed in position in the front-rear direction by the lock surface 151 contacting the shaft 145 from the front side thereof. However, the positioning means for the ink cartridge 30 is not limited to this contact between the lock surface 151 and shaft 145. For example, the ink cartridge 30 may be fixed in the front-rear direction through sliding resistance between the positioning surface 89 of the ink cartridge 30 and the bottom surface on the protruding part 114 of the cartridge-attachment portion 110, and sliding resistance between the bottom surface 42A of the ink cartridge 30 and the inner top surface on the bottom wall 59 of the cartridge-attachment portion 110. Alternatively, the ink cartridge 30 may be fixed in the front-rear direction through sliding resistance between the sealing member 76 of the ink cartridge 30 and the tube 102 of the cartridge-attachment portion 110, for example.

Figure 20:
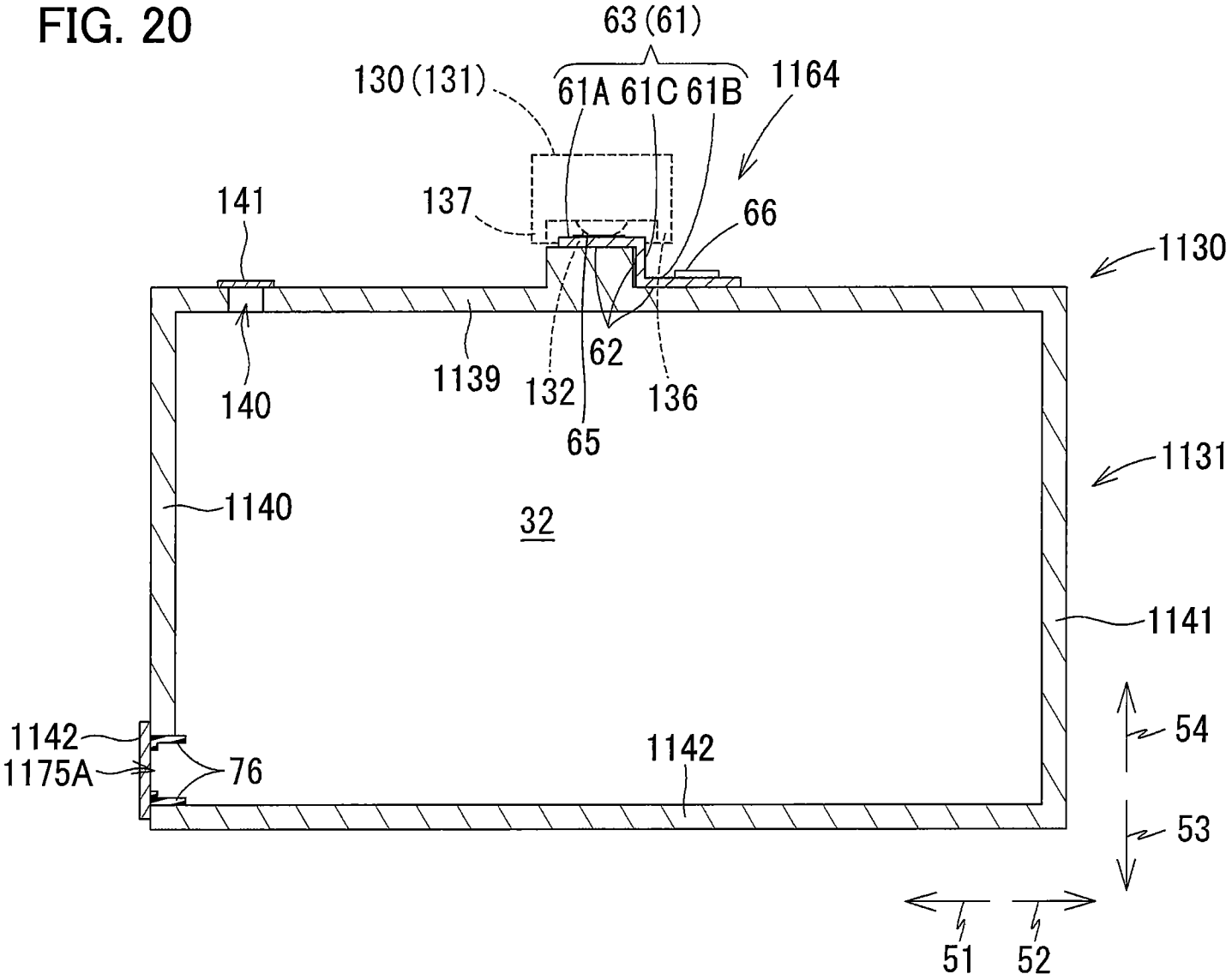
FIG. 20 is a vertical schematic cross-sectional view of an ink cartridge according to another variation of the embodiment.

The structure of the ink cartridge 30 is not limited to those shown in FIGS. 4 to 6 and 12A through 19D. For example, FIG. 20 depicts an ink cartridge 1130 according to another variation of the embodiment. In the structure shown in FIG. 20, the ink cartridge 1130 includes a housing 1131 and a circuit board 1164 fixed to a top wall 1139 of the housing 1131. The housing 1131 has a substantially rectangular parallelepiped shape. Hence, a rear wall 1141 and a front wall 1140 respectively extend vertically, while a bottom wall 1142 and the top wall 1139 extend horizontally. The ink cartridge 1130 does not include the projection 67, positioning surface 89, protruding part 43, operating part 90, cylinder 75, valve 79, and coil spring 80, unlike the ink cartridge 30 of the depicted embodiment. A passage 1175A is closed by a seal 1142. The circuit board 1164 includes the substrate 63 of the depicted embodiment, but the battery 68 is dispensed with. The memory 66 is mounted on the second region 61B on the first surface 61 of the substrate 63.

With the structure shown in FIG. 20, the ink cartridge 1130 is inserted into the cartridge holder 101 of the cartridge-attachment portion 110, without being pivoted upward, in a direction diagonally upward and frontward. If the ink cartridge 1130 is inserted horizontally in the front-rear direction without being pivoted, the rear wall 136 of the connector 130 needs to be omitted as described above, in order to prevent interference between the substrate 63 and the connector 130 during the insertion of the ink cartridge 1130 into the cartridge-attachment section 110.

Figure 21:
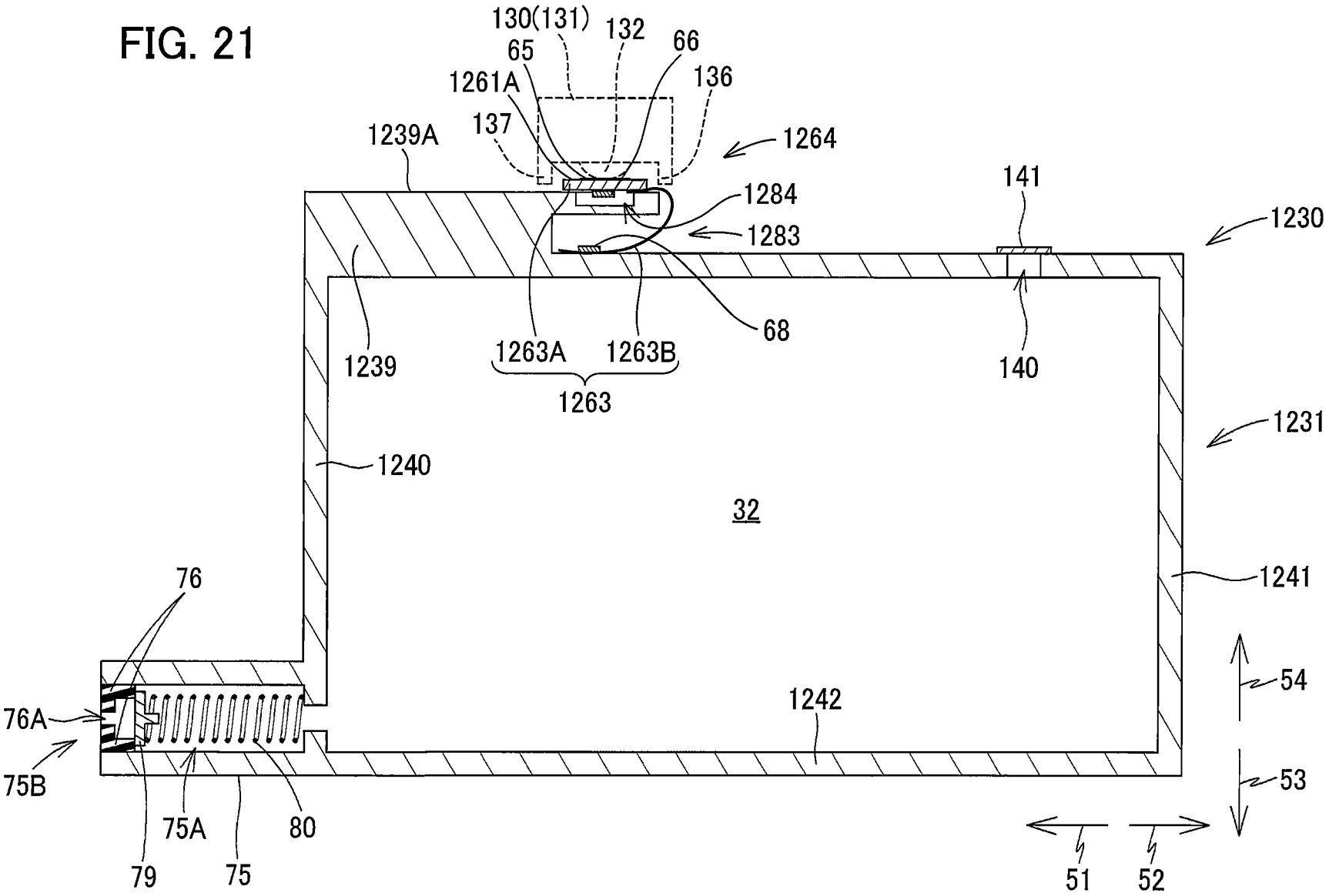
FIG. 21 is a vertical schematic cross-sectional view of an ink cartridge according to still another variation of the embodiment.

FIG. 21 shows an ink cartridge 1230 according to still another variation to the embodiment. The ink cartridge 1230 includes a housing 1231, and a circuit board 1264 arranged on a top wall 1239 of the housing 1231. The circuit board 1264 includes a substrate 1263 configured of a first substrate 1263A and a second substrate 1263B. The first substrate 1263A is a rigid substrate and is fixed to a top surface 1239A of the top wall 1239. The second substrate 1263B is a flexible substrate having one end (upper end) connected to the first substrate 1263A. The flexible second substrate 1263B is curved such that another end (lower end) of the second substrate 1263B is arranged in a recess 1283 formed in the top wall 1239, the recess 1283 being is open rearward. That is, the lower end of the second substrate 1263B is positioned below the first substrate 1263A in the upright posture. The electrodes 65 are formed on an upper surface of the first substrate 1263A, as in the depicted embodiment. The memory 66 is mounted on a lower surface of the first substrate 1263A. A depression 1284 is formed in the top surface 1239A of the top wall 1239 such that the memory 66 mounted on the lower surface of the first substrate 1263A is accommodated in the depression 1284. The battery 68 is mounted on the second substrate 1263B at a position below the memory 66 within the recess 1283. That is, the memory 66 and battery 68 are aligned with one another in the vertical direction.

With this structure of FIG. 21, even if there occurs interference between the substrate 1263 and the cartridge-attachment section 110 during the insertion of the ink cartridge 1230 into the cartridge-attachment section 110, impact resulting from the interference is less likely to be impinged directly onto the battery 68 that is accommodated within the recess 1283. Note that, in the structure of FIG. 21, the second substrate 1263B may be configured of a wire electrically connecting the battery 68 to the memory 66.

Further, the housing of the liquid cartridge of the disclosure may not necessarily be configured as a single member, but may be configured of a plurality of members assembled to each other. Likewise, the top wall of the housing may not necessarily be configured of a single member but may be configured of a plurality of members assembled to each other. That is, the substrate of the disclosure may be supported by an upper wall configured of more than one member.

Still further, in the depicted embodiment and various modifications, the substrate is bonded to the top surface of the top wall of the housing, i.e., directly supported by the top wall of the housing. Alternatively, the substrate of the present disclosure may be supported indirectly by the top wall of the housing, through a separate member or even through a plurality of members.

In the depicted embodiment, ink is described as an example of liquid, but the liquid cartridge may store a liquid other than ink, such as a pretreatment liquid that is ejected onto sheets or the like prior to ink during a printing operation, or water for cleaning the recording head 21.

It should be apparent to those who skilled in the art that the embodiment, various modifications thereto and variations described above may be combined with one another as appropriate.

REMARKS

The ink cartridges 30, 230, 330, 430, 530, 630, 730 and 1130 are an example of a liquid cartridge. The cartridge-attachment portion 110 is an example of an attachment portion. The printer 10 is an example of a printing device. The storage chamber 32 is an example of a liquid chamber. The passages 75A and 1175A are an example of a liquid passage. The substrates 63, 263, 363, 463, 563, 663 and 763 are an example of a substrate. The electrodes 65 are an example of a contact of the cartridge. The memory 66 is an example of a memory. The battery 68 is an example of an electronic component. The first surfaces 61, 261, 361, 461, 561, 661 and 761 are an example of a first surface. The second surfaces 62, 262, 362, 462, 562, 662 and 762 are an example of a second surface. The first regions 61A, 261A, 361A, 461A, 561A, 661A and 761A are an example of a first region. The second regions 61B, 261B, 361B, 461B, 561B, 661B and 761B are an example of a second region. The third regions 261D and 461D are an example of a third region. The step 61C is an example of a step. The first substrates 563A, 763A are an example of a first substrate. The second substrates 563B1, 563B2 and 763B are an example of a second substrate. The shaft 145 is an example of a restricting part. The lock surface 151 is an example of a contact surface. The cartridge holder 101 is an example of a holder. The tube 102 is an example of a tube. The connector 130 is an example of a connector. The contacts 132 are an example of a contact of the device. The front wall 137 is an example of a first wall. The rear wall 136 is an example of a second wall. The right wall 138 is an example of a third wall, and the left wall 139 is an example of a fourth wall.

What is claimed is:

1. A liquid cartridge configured to be inserted into an attachment portion of a printing device in an insertion direction crossing a gravitational direction and attached to the attachment portion in an upright posture, the attachment portion including a contact, the liquid cartridge comprising:

a liquid chamber storing liquid therein;

a liquid passage in communication with the liquid chamber and extending frontward in the insertion direction from the liquid chamber;

a substrate having a first surface and a second surface opposite to each other, the first surface comprising a first region and a second region, the first region facing upward in the upright posture, the second region being positioned lower than the first region in the upright posture;

a contact formed on the first region of the first surface, the contact of the cartridge being electrically connectable to the contact of the device; and a memory electrically connected to the contact of the cartridge, the memory being mounted on the substrate at a position lower than the contact of the cartridge in the upright posture.

2. The liquid cartridge according to claim 1, wherein the second region is positioned rearward relative to the first region in the insertion direction.

3. The liquid cartridge according to claim 2, wherein the first surface further includes a third region connected to a rear edge of the second region in the insertion direction, the third region being higher than the second region in the upright posture, and wherein the memory is mounted on the second surface at a region opposite the third region.

4. The liquid cartridge according to claim 1, wherein the second region is positioned frontward relative to the first region in the insertion direction in the upright posture.

5. The liquid cartridge according to claim 4, wherein the first surface further includes a third region connected to a front edge of the second region in the insertion direction, the third region being positioned higher than the second region and lower than the first region in the upright posture.

6. The liquid cartridge according to claim 5, wherein the memory is mounted on the second surface at a region opposite the third region.

7. The liquid cartridge according to claim 1, wherein the memory is mounted on the second surface at a region opposite the second region.

8. The liquid cartridge according to claim 1, wherein the first surface further comprises a step connecting the first region to the second region, the step and the second region defining a recess that is recessed downward relative to the first region in the upright posture, and wherein the memory is mounted on the second surface at a region opposite the step.

9. The liquid cartridge according to claim 1, wherein the substrate comprises:

a first substrate having an upper surface and a lower surface, the upper surface constituting the first region in the upright posture; and a second substrate having an upper surface fixed to the lower surface of the first substrate, the second substrate having a lower surface constituting the second surface.

10. The liquid cartridge according to claim 1, wherein the substrate is a flexible substrate.

11. The liquid cartridge according to claim 1, further comprising an electronic component electrically connected to the memory and configured to supply power to the memory, wherein the substrate comprises:

a first substrate having rigidity, the first substrate having an upper surface and a lower surface, the upper surface constituting the first region; and a second substrate having flexibility and connected to the lower surface of the first substrate, the second substrate having a lower surface constituting the second surface, the electronic component being mounted on the second surface.

12. The liquid cartridge according to claim 1, further comprising an electronic component electrically connected to the memory and configured to supply power to the memory, the electronic component being mounted on the second surface.

13. The liquid cartridge according to claim 12, wherein the electronic component is mounted on the second surface at a position farther away from the first region than the memory is from the first region in the insertion direction.

14. The liquid cartridge according to claim 1, further comprising:

a front wall at which one end of the liquid passage is open;

a rear wall opposite the front wall in the insertion direction in the upright posture;

an upper wall disposed between the front wall and the rear wall; and a bottom wall opposite the upper wall in the gravitational direction in the upright posture, the liquid chamber being positioned between the front wall and the rear wall in the insertion direction and between the upper wall and the bottom wall in the gravitational direction in the upright posture, and wherein the substrate is supported by the upper wall.

15. The liquid cartridge according to claim 14, wherein the attachment portion further comprises a restricting part, wherein the liquid cartridge further comprises a contact surface configured to make contact with the restricting part, contact of the contact surface against the restricting part restricting the liquid cartridge from moving in a removal direction opposite to the insertion direction against an urging force acting in the removal direction, and wherein the contact surface is positioned upward and rearward in the insertion direction relative to the contact of the cartridge in the upright posture.

16. The liquid cartridge according to claim 1, wherein the contact of the cartridge extends in the insertion direction in the upright posture.

17. The liquid cartridge according to claim 1, wherein the substrate has a length in the insertion direction and a width in a widthwise direction perpendicular to the insertion direction and the gravitational direction, the length in the insertion direction being greater than the width in the widthwise direction.

18. A system comprising:

the liquid cartridge according to claim 1; and an attachment portion of a printing device, the liquid cartridge being configured to be inserted into the attachment portion in an insertion direction and attached to the attachment portion in an upright posture, the attachment portion comprising:

a holder defining an internal space therein for accommodating the liquid cartridge in the upright posture, the holder comprising:

a bottom wall;

an upper wall spaced apart from the bottom wall in a height direction parallel to the gravitational direction in the upright posture; and a pair of side walls each connecting the bottom wall and the upper wall, the side walls being spaced apart from each other in a widthwise direction orthogonal to the height direction and the insertion direction, the upper wall, the bottom wall and the pair of side walls defining the internal space;

a tube provided at the holder and connectable to the liquid passage of the liquid cartridge; and a connector comprising:

a contact disposed at the upper wall and configured to contact the contact of the liquid cartridge in an attached state;

a first wall having a first lower end in the height direction, the first lower end being positioned lower than the contact of the device in the height direction; and a second wall spaced apart from the first wall in the insertion direction, the second wall having a second lower end in the height direction, the second lower end being positioned lower than the contact of the device in the height direction, the contact of the device being positioned between the first wall and the second wall in the insertion direction, the second region of the substrate being separated from at least one of the first lower end and the second lower end in the height direction in the attached state of the liquid cartridge.

19. The system according to claim 18, wherein the connector further comprises:

a third wall having a third lower end in the height direction, the third lower end being positioned lower than the contact of the device in the height direction; and a fourth wall spaced apart from the third wall in the widthwise direction, the fourth wall having a fourth lower end in the height direction, the fourth lower end being positioned lower than the contact of the device in the height direction, the contact of the device being positioned between the third wall and the fourth wall in the widthwise direction.

20. A liquid cartridge configured to be inserted into an attachment portion in an insertion direction of a printing device crossing a gravitational direction and attached to the attachment portion in an upright posture, the attachment portion including a contact, the liquid cartridge comprising:

a liquid chamber storing liquid therein;

a liquid passage in communication with the liquid chamber and extending frontward in the insertion direction from the liquid chamber;

a substrate having a first surface and a second surface opposite to each other, the first surface comprising:

a first region facing upward in the upright posture;

a second region positioned lower than the first region in the upright posture; and a third region positioned rearward in the insertion direction relative to the second region in the upright posture, the third region being positioned higher than the second region in the upright posture;

a contact formed on the first region of the first surface, the contact of the cartridge being electrically connectable to the contact of the device; and a memory electrically connected to the contact of the cartridge, the memory being mounted at one of the second surface and the third region.

* * * * *